US010982913B2

(12) United States Patent
Hemker et al.

(10) Patent No.: US 10,982,913 B2
(45) Date of Patent: Apr. 20, 2021

(54) THREE DIMENSIONAL WOVEN LATTICES AS MULTI-FUNCTIONAL HEAT EXCHANGER

(71) Applicants: THE JOHNS HOPKINS UNIVERSITY, Baltimore, MD (US); SAERTEX USA, LLC, Huntersville, NC (US)

(72) Inventors: Kevin J. Hemker, Reisterstown, MD (US); Timothy P. Weihs, Baltimore, MD (US); Stephen Ryan, Towson, MD (US); Longyu Zhao, Baltimore, MD (US); Seunghyun Ha, Nam-gu Busan (KR); Yong Zhang, Baltimore, MD (US); Sen Lin, Baltimore, MD (US); James K. Guest, Lutherville Timonium, MD (US); Keith Sharp, Huntersville, NC (US)

(73) Assignees: The Johns Hopkins University, Baltimore, MD (US); Saertex USA, LLC, Huntersville, NC (US)

( * ) Notice: Subject to any disclaimer, the term of this patent is extended or adjusted under 35 U.S.C. 154(b) by 1041 days.

(21) Appl. No.: 15/161,945

(22) Filed: May 23, 2016

(65) Prior Publication Data

US 2016/0363389 A1 Dec. 15, 2016

Related U.S. Application Data

(60) Provisional application No. 62/165,373, filed on May 22, 2015, provisional application No. 62/238,292, filed on Oct. 7, 2015.

(51) Int. Cl.

| | |
|---|---|
| ***F28F 3/02*** | (2006.01) |
| ***F28F 13/00*** | (2006.01) |
| ***F28F 21/08*** | (2006.01) |

(52) U.S. Cl.
CPC ..... *F28F 3/022* (2013.01); *F28F 13/003* (2013.01); *F28F 21/08* (2013.01)

(58) Field of Classification Search
CPC ..... F28F 3/022; F28F 13/003; F28F 21/08; F28F 1/32; F28F 1/36

(Continued)

(56) References Cited

U.S. PATENT DOCUMENTS 2,505,619 A * 4/1950 Holm ..... F28F 3/022 165/166
2,663,550 A * 12/1953 Hammond ..... F28F 3/022 165/166

(Continued)

FOREIGN PATENT DOCUMENTS

JP 2015056218 A 3/2015
WO 2015034181 A1 3/2015

OTHER PUBLICATIONS

Simone, A., et al., "Effects of solid distribution on the stiffness and strength of metallic foams", Acta mater. (1998) vol. 46, No. 6, pp. 2129-2150.

(Continued)

*Primary Examiner* — Tho V Duong
*Assistant Examiner* — Raheena R Malik
(74) *Attorney, Agent, or Firm* — Harrity & Harrity, LLP

(57) ABSTRACT

The present invention is directed to devices formed from three dimensional (3D) structures composed of wires, yarns of wires, or 3D printed structures. The devices of the present invention offer the potential for 3D structures with multiple properties optimized concurrently, using optimization within the 3D manufacturing constraints. The 3D structures of the present invention include multiple properties that are optimized for heat transfer applications. The present invention also includes the methods for optimization of the 3D (Continued)

woven lattices as well as methods of use of the 3D woven lattices in heat transfer applications.

18 Claims, 14 Drawing Sheets

(58) Field of Classification Search
USPC ..... 165/185
See application file for complete search history.

(56) References Cited

U.S. PATENT DOCUMENTS

| | | | | |
|---|---|---|---|---|
| 2,670,936 | A * | 3/1954 | Jensen | F28F 3/022 165/170 |
| 2,870,998 | A * | 1/1959 | Woolard | F28F 3/022 165/166 |
| 5,317,805 | A * | 6/1994 | Hoopman | B23P 15/26 257/E23.098 |
| 5,358,032 | A * | 10/1994 | Arai | F28F 3/022 165/80.3 |
| 5,769,157 | A * | 6/1998 | Ikejima | B23K 1/0012 165/184 |
| 6,173,758 | B1 * | 1/2001 | Ward | F28F 3/022 165/185 |
| 6,315,007 | B1 | 11/2001 | Mohamed et al. | |
| 7,484,589 | B2 | 2/2009 | Guo et al. | |
| 7,628,179 | B2 | 12/2009 | Mohamed | |
| 8,544,597 | B1 | 10/2013 | McEnerney et al. | |
| 8,695,375 | B2 | 4/2014 | Kirkwood | |
| 8,726,976 | B2 * | 5/2014 | Schrader | F28D 1/0426 165/140 |
| 8,739,855 | B2 | 6/2014 | Fritz et al. | |
| 8,746,330 | B2 | 6/2014 | Lyon | |
| 8,776,874 | B2 | 7/2014 | Hu | |
| 8,920,879 | B2 * | 12/2014 | Toohey | B29C 73/22 427/384 |
| 2004/0226620 | A1 * | 11/2004 | Therriault | B01F 5/0604 137/825 |
| 2005/0150649 | A1 * | 7/2005 | Tsukamoto | F28F 3/022 165/185 |
| 2009/0317236 | A1 | 12/2009 | Hardwicke et al. | |
| 2010/0194179 | A1 | 8/2010 | Waltz | |
| 2011/0133025 | A1 | 6/2011 | Vauchel et al. | |
| 2012/0261106 | A1 * | 10/2012 | Kelly | F28F 3/022 165/185 |
| 2014/0054020 | A1 * | 2/2014 | Kroener | F28F 21/085 165/185 |
| 2015/0199952 | A1 | 7/2015 | Amini et al. | |
| 2015/0240072 | A1 * | 8/2015 | Esser-Kahn | B32B 3/20 525/450 |
| 2016/0314953 | A1 | 10/2016 | Addleman et al. | |

OTHER PUBLICATIONS

Roper, C., et al., "Anisotropic Convective Heat Transfer in Microlattice Materials" (2013) vol. 59, No. 2, pp. 622-629.
Torquato, S., et al., "Optimal Bounds on the Trapping Constant and Permeability of Porous Media" Physical Review Letters (2004) vol. 92, No. 25.
Gibiansky, L., et al., "Link between the Conductivity and Elastic Moduli of Composite Materials", Physical Review Letters, (1993) vol. 71, No. 18, pp. 2927-2930.
Challis, V., et al., "Computationally generated cross-property bounds for stiffness and fluid permeability using topology optimization" Int. J. Solids Struct. (2012) vol. 49 pp. 3397-3408.
Zhao, L., et al., "Permeability measurements and modeling of topology-optimized metallic 3-D woven lattices" Acta Mater. (2014) vol. 81, pp. 326-336.
Patrick, J., et al., "Continuouts Self-Healing Life Cycle in Vascularized Structural Composite", Advanced Materials, (2014) vol. 26, pp. 4302-4308.
Sce, A., et al., "High density die casting (HDDC); new frontiers in the manufacturing of heat sinks" Journal of Physics: Conference Series 525 (2014).
Archer E., et al., "The Effect of 3D Weaving and Consolidation on Carbon Fiber Tows, Fabrics, and Composites," Journal of Reinforced Plastics and Composites, Aug. 2010, vol. 29 (20), pp. 3162-3170.
Liao I., et al., "Composite Three-Dimensional Woven Scaffolds with Interpenetrating Network Hydrogels to Create Functional Synthetic Articular Cartilage," Advanced Functional Materials, Dec. 2013, vol. 23 (47), pp. 5833-5839.
Liberski A., et al., "Organ Weaving: Woven Threads and Sheets as a Step Towards a New Strategy for Artificial Organ Development," Macromolecular Bioscience, Nov. 2011, vol. 11 (11), pp. 1491-1498.
Liu Y., et al., "Weaving of Organic Threads into a Crystalline Covalent Organic Framework," Science, Jan. 2016, vol. 351 (6271), pp. 365-369.
Malvankar N.S., et al., "Microbial Nanowires: A New Paradigm for Biological Electron Transfer and Bioelectronics," ChemSusChem, Jun. 2012, vol. 5 (6), pp. 1039-1046.
Moutos F., et al., "A Biomimetic Three-Dimensional Woven Composite Scaffold for Functional Tissue Engineering of Cartilage," Nature Materials, Jan. 2007, vol. 6 (162), pp. 162-167.
Onoe H., et al., "Metre-Long Cell-Laden Microfibres Exhibit Tissue Morphologies and Functions," Nature Materials, Mar. 2013, vol. 12 (584), pp. 584-590.
Sharp K., et al., "Metallic Cellular Materials Produced by 3D Weaving," Procedia Materials Science, vol. 4, 2014, pp. 15-20.

* cited by examiner

WATER

WATER

AIR

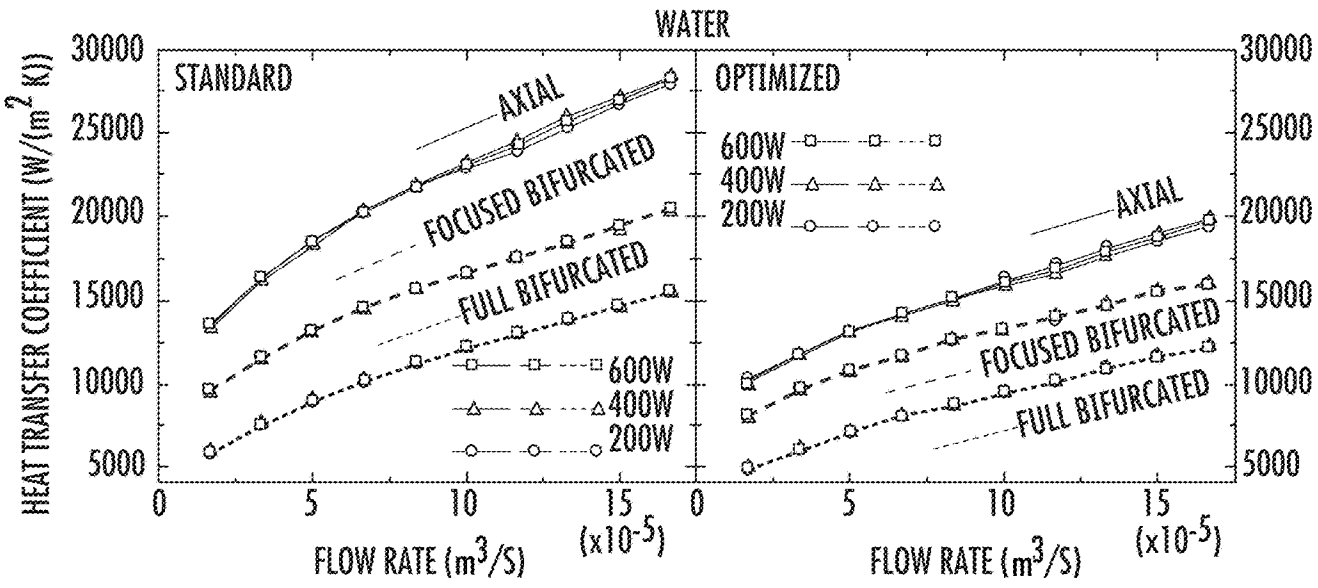
FIG. 9A
FIG. 9B
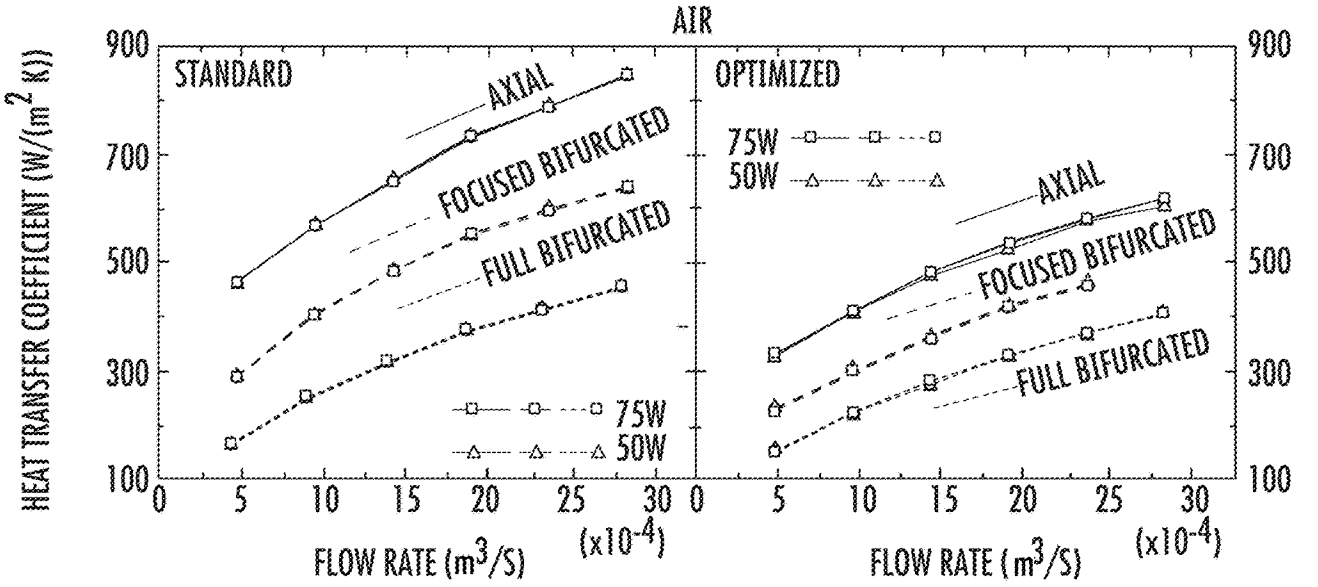
FIG. 9C
FIG. 9D

THREE DIMENSIONAL WOVEN LATTICES AS MULTI-FUNCTIONAL HEAT EXCHANGER

CROSS REFERENCE TO RELATED APPLICATIONS

This application claims the benefit of U.S. Provisional Patent Application No. 62/165,373 filed May 22, 2015 and U.S. Provisional Patent Application No. 62/238,292 filed Oct. 7, 2015, which are incorporated by reference herein, in their entirety.

GOVERNMENT RIGHTS

This invention was made with government support under W91CRB1010004 awarded by the Defense Advanced Research Projects Agency. The government has certain rights in the invention.

FIELD OF THE INVENTION

The present invention relates to cellular materials in which one or more properties have been optimized. More particularly the present invention relates to a three-dimensional woven lattice that serves as multi-functional heat exchanger in an optimized manner.

BACKGROUND OF THE INVENTION

'Cellular metal' has been used as a general term used to describe metallic bodies within which liquid filled or gaseous voids are dispersed. Depending on the configuration of the pore structure, cellular metals are classified as either stochastic structures such as metal foams or periodic structures such as prismatic topologies, truss architectures or screen textiles. Each possesses unique combinations of fluidic, mechanical or thermal properties.

One of the most important and beneficial applications of cellular metals is as heat exchangers due to their excellent thermal conductivity, high specific surface area and effective fluid mixing. Heat exchangers are commonly found in thermal power plants, transportation vehicles, air conditioning and heating systems, chemical processing, electronic equipment and space vehicles. Compact heat exchangers using cellular materials are valuable for the enhancement of heat transfer at small length scales, as well as for reducing mass and volume of the device. For instance, in applications such as cooling laser diodes, large amounts of heat need to be dissipated from a small area while temperature uniformity across that area is required as well.

In addition to conducting heat, cellular metals offer multifunctionality. For instance, a heat exchanger capable of providing structural support could reduce system-level parasitic weight, which is especially useful in transportation. Other examples include multifunctional heat sinks, heat pipes, and heat transfer devices that have been developed using a variety of stochastic, and periodic cellular materials.

Metal foams are the most common stochastic heat exchangers. Having low densities, low cost and novel thermal, mechanical, electrical and acoustic properties, they have been used for applications such as air-cooled condenser towers, high power batteries, and heat pipes. The open-cell foams possess desirable qualities for heat exchangers, i.e. a high specific solid-fluid interface surface area, a thermally conductive solid phase, and a tortuous coolant flow path to promote fluid mixing.

However, metal foams do have limitations as well. First, their stochastic nature leads to high impedance and large pressure losses. Second, their deformation under mechanical loading is bending-dominated rather than stretching-dominated as is typical of periodic structures. Combining with their typical low densities, this preferred deformation mode results in low stiffness and strength for metal foams, which limits their use in load-bearing applications. Third, due to the irregular cell geometries, predicting cell behavior can be challenging. For instance, prior research in this area proposed different simplified cell geometries to simulate real metallic foams structures, but all have discrepancies when trying to predict the foams' behavior. Fourth, manufacturing methods such as injecting gas into molten metal or mixing foaming agent into molten metal induce morphological imperfections and wide dispersion in cell size and cell shape, both of which degrade stiffness and strength. For these reasons, foams are less than ideally suited for structural applications and various periodic structures have since been explored.

Periodic cellular structures have also been developed recently for heat exchange applications. Different topologies have been proposed, from relatively simple structures such as louvered fins, shell and tubes, and prismatic lattices, to more complicated structures such as hollow micro lattices, woven meshes, and Kagome trusses. Due to their periodicity, many of these structures have proven quite successful, especially because of their ability to bear load and actively cool. Theoretical and numerical solutions can also be explored using their unit cell structures, and the design space for such structures is very large, enabling applications with a range of requirements.

Although there have been many successes with these periodic structures, further improvement is still possible. None of the existing materials have been designed using topology optimization, which could lead to even more functionality and superior properties.

Stochastic porous heat exchangers such as metallic foams normally have very low mechanical stiffness (shear modulus less than 0.5 GPa), limited volume density (typically less than 15%), non-regular pore sizes and require high pumping power. As a result, they usually fail to satisfy structural load or pumping power requirements when pursuing heat transfer.

Regular porous heat exchangers such as fins and trusses are typically designed so as to optimize only one property and often in only in one direction. They tend to underperform in applications that require multiple properties to be optimized simultaneously, particularly in multiple directions.

Some thermal management applications require multiple properties, such as heat transfer, fluidic permeability, pumping power, temperature uniformity or mechanical stiffness to be optimized. In some cases two or more properties must be optimized in different directions.

The design of existing porous heat exchangers is typically iterative in nature, through a series of experiments—fabricate, characterize and repeat—which can be time consuming and expensive. To overcome this, finite element modeling (FEM) is extensively used to simulate a material's property, yet most efforts typically focus on one property. Recently, topology optimization was developed to design architectural material with multiple properties optimized simultaneously. However, the suggested topologies are completely ideal for the targeted properties and do not consider manufacturing constraints, which makes some of the proposed structures impossible to manufacture. Besides, optimizing multiple properties simultaneously is challenging if different properties need to be optimized in different directions.

It would therefore be advantageous to provide a custom designed cellular structure that satisfied multiple property requirements. For example, it would be advantageous to provide a custom designed cellular structure for use as a multi-functional heat exchanger in which multiple properties of the mesh are optimized simultaneously in different directions.

BRIEF DESCRIPTION OF THE FIGURES

FIGS. 9A-9D illustrate graphical views of heat transfer coefficient vs. flow rate with three flow patterns using either water, as in FIG. 9A or 9B or air, as in FIGS. 9C and 9D, as working fluid, on a standard, as in FIGS. 9A and 9C or optimized, as in FIGS. 9B and 9D, structure. For water, three different heat fluxes were applied (600 W, 400 W and 200 W); while for air, two different heat fluxes were applied (75 W and 50 W).

SUMMARY

Figure 1A:
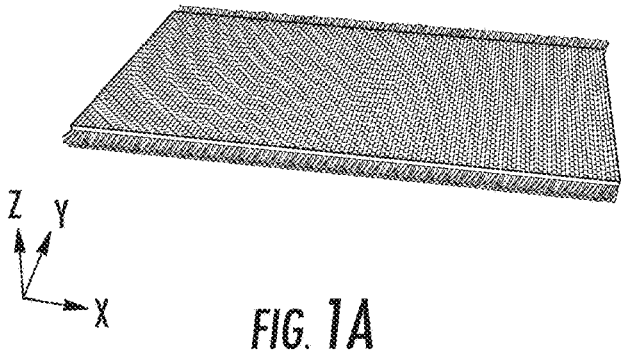
FIG. 1A illustrates a perspective view of 3 mm thick, unbonded, optimized single layer Cu weaves that were cut to around 85 mm in length (X), and approximately 35 mm in width (Y).

The foregoing needs are met, to a great extent, by the present invention, wherein in one aspect a device for providing heat management includes wires configured to create a heat management material. Parameters of the wires are altered to enhance heat management qualities of the material.

In accordance with an aspect of the present invention, the heat management qualities of the material are chosen from a group including pressure drop, pumping power, heat transfer and temperature uniformity. The wires can be formed from a metal, a ceramic, and a polymer. Alternately, the wires are formed from Cu or also from a non-metal. The diameters of wires are the same or different. The wires are woven with a warp and a fill. The wires can also be woven with a warp, fill, and a Z wire. The wires can be bonded. A wire can be composed of a bonding materials such as a braze or a solder. An optimization is performed to design a weave with properties that are optimized in one or more directions. Pore size, flow pattern, and volume density can be used to optimize heat transfer and fluid flow through the device and pumping power required for fluid flow. The parameters of the wires can be chosen using topology optimization, intuition motivated architectures, and mechanical-based design. Wire position, wire material chemistry, wire size, wire coating, roughness, wire shape, wire bonding, varying composition of wires in the structure, and wire architecture can all be altered. The wire can take the form of a yarn. The parameters of the wires can be altered to enhance mechanical stiffness, fluid permeability, and pumping power required for fluid flow. The wires can be solid or hollow In accordance with another aspect of the present invention, a method for forming a heat management material includes positioning wires in x-, y-, and z-directions to form the heat management material. Parameters of the wires are chosen to provide heat management.

In accordance with yet another aspect of the present invention, parameters of the wires are selected to provide heat management using one selected from a group consisting of topology optimization, intuition motivated architectures, and mechanical-based design. Parameters of the wires to be altered include wire position, wire material chemistry, wire size, wire coating, roughness, wire shape, wire bonding, and wire architecture. The heat transferring material can be generated using three dimensional printing.

DETAILED DESCRIPTION OF THE PREFERRED EMBODIMENTS

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

The present invention is directed to devices formed from three-dimensional (3D) structures composed of metallic, ceramic, or polymeric wires or bundles and yarns of wires that are either solid or hollow like a tube. The 3D structures can take the form of lattices, can be woven, and/or can be 3D printed. The devices of the present invention offer the potential for 3D structures with multiple properties optimized concurrently, in some cases using a topology optimization routine that includes the 3D weaving manufacturing constraints. Other forms of optimization can also be used, such as intuition motivated architecture and mechanical based design. The properties can be optimized in different directions. The 3D structures of the present invention include multiple properties that are optimized for a range of different applications, including heat transfer. The present invention also includes the methods for optimization of the 3D structures as well as methods of use of the 3D structures in heat management applications.

The present invention also includes methods for optimizing and manufacturing the 3D structures described herein. The present invention can be used to provide enhanced heat management by improving one or more of heat transfer, pressure drop, or temperature uniformity. This can be accomplished by altering parameters of the wires and thereby the properties of the overall heat management material. Wire parameters that can be altered include wire position, wire material chemistry, wire size, wire coating, roughness, wire shape, wire bonding, varying composition of each wire, and wire architecture. This list is not meant to be considered limiting and any wire parameter or property known to or conceivable by one of skill in the art can also be altered. Alterations of wire parameters can affect mechanical stiffness, fluid permeability, and pumping power required for fluid flow. It should be noted that as used throughout the present application "optimize" and variations thereof are understood to be the choice of certain design, properties, materials, manufacture, etc. to provide the desired results from the present invention for a predetermined set of parameters.

With 3D structures that have well defined unit cell geometries, one can control pore size, flow patterns, and volume density to optimize flow and heat transfer while still maintaining a high mechanical stiffness (after bonding such as soldering, brazing or electroplating). The volume density of the structure can reach over 40% thus providing a high mechanical stiffness (shear modulus over 2.5 GPa for copper optimized structure) with high permeability (normalized permeability of $10^{-2}$ vs. $10^{-4}$ for metal foam with similar volume fraction).

There is great flexibility in the design of 3D structures, with different lattice structures and multiple choices of materials. One can decouple and optimize mechanical stiffness and fluid permeability simultaneously, and these can be extended to include other properties such as heat transfer, pumping power, temperature uniformity or mechanical strength to build a multi-functional device such as a heat exchanger. For instance: fluid permeability, heat transfer and mechanical stiffness can be optimized for load bearing heat exchangers, such as a load bearing heat sink; and pumping power, heat transfer and temperature variation can be optimized for high power density heat exchangers, such as those needed for high-power laser diode devices.

Variables or parameters for optimization include wire position, wire material chemistry, wire size, wire coating to change surface structure, roughness, varying wire composition, wire shape, and wire bonding. Wire architecture can be altered, including removal of wires to alter flow properties. If wires are used to form the 3D structure, the wires can be used individually or as a yarn formed from a number or wires or bundles of wires. Devices of the present invention can be designed and optimized to include the variables of optimization described herein. These designs can be woven, but can also be 3D printed to represent the desired structures instead of woven with wires. Wires can be uniformly formed from one material or different wires in the 3D structure can be formed from varying materials in order to further optimize properties of the material.

Topology optimization that accounts for the 3D weaving manufacturing constraints can be used to design the internal structures in some embodiments. This optimization method can decouple and simultaneously optimize multiple properties, while accommodating the optimization method parameters that are critical to the weaving process. Modeling matches experimental results very well. As a result, for specific applications, 3D woven lattices can be designed and optimized computationally instead of through iterative experiments. Other possible optimization methods include intuition motivated architectures, and mechanical-based design.

The present invention can be implemented in a number of ways in order to provide multiple functionalities. The design and manufacture of the device can be varied in order to optimize different properties such as heat transfer. A number of examples and ranges are given below, with respect to the design, properties, materials, and manufacture of a device according to the present invention. These examples and ranges are in no way meant to be considered limiting, and any suitable design, properties, materials, or methods of manufacture known to or conceivable by one of skill in the art could also be used. It should be noted that as used throughout the present application "optimize" and variations thereof are understood to be the choice of certain design, properties, materials, manufacture, etc. to provide the desired results from the present invention for a predetermined set of parameters. The present invention is directed generally to 3D structures, such as a woven lattice, in which multiple properties are optimized simultaneously. As an example, the present invention can take the form of a heat transfer device that allows cooling fluid or gas to flow in any desired non-orthogonal direction and for which one property is optimized or more than one property is optimized simultaneously.

More particularly, a heat transfer device according to the present invention can allow cooling fluid or gas to flow in positive or negative directions and for which more than one property is optimized simultaneously. Volume fraction and normalized permeability for the heat transfer device can be optimized in more than one direction. For instance, when using Cu as the weaving material and "standard/optimized" architecture as the lattice structure, material volume fraction is between 31% and 43% for the measured range, between 24% and 52% for the expandable range, and between 10% and 65% for the broad range, while normalized permeability is between 0.004 and 0.014 for the measured range, between 0.001 and 0.04 for the expandable range, and between 0.0001 and 0.4 for the broad range.

Volume fraction and mechanical properties can be optimized in more than one direction. For instance, when using metals or ceramics as the weaving material and "standard/optimized" architecture as the lattice structure, volume fraction is between 31% and 43% for the measured range, between 24% and 52% for the expandable range, and between 10% and 65% for the broad range, while Young's modulus is between 10 and 20 GPa for the measured range, between 5 and 40 GPa for the expandable range, and between 0.01 and 200 GPa for the broad range, shear modulus is between 2.5 and 7 GPa for the measured range, between 1.5 and 12 GPa for the expandable range, and between 0.005 and 100 GPa for the broad range, and strength is between 30 and 45 MPa for the measured range, between 5 and 60 MPa for the expandable range, and between 1 and 300 MPa for the broad range. When using polymers as the weaving material, water as coolant and "standard/optimized" architecture as lattice structure, volume fraction is between 31% and 43% for the measured range, between 24% and 52% for the expandable range, and between 10% and 65% for the broad range, while shear modulus and Young's Modulus are between 0.05 and 0.5 GPa for the measured range, between 0.01 and 1.5 GPa for the expandable range, and between 0.001 and 4 GPa for the broad range, and strength is between 0.5 MPa and 5 MPa for the measured range, between 0.2 MPa and 20 MPa for the expandable range, and between 0.05 and 50 MPa for the broad range.

Normalized permeability and mechanical properties can be optimized in more than one direction. For instance, when using metals or ceramics as the weaving material and "standard/optimized" architecture as the lattice structure, normalized permeability is between 0.004 and 0.014 for the measured range, between 0.001 and 0.04 for the expandable range, and between 0.0001 and 0.4 for the broad range, while Young's modulus is between 10 and 20 GPa for the measured range, between 5 and 40 GPa for the expandable range, and between 0.01 and 200 GPa for the broad range, shear modulus is between 2.5 and 7 GPa for the measured range, between 1.5 and 12 GPa for the expandable range, and between 0.1 and 100 GPa for the broad range, and strength is between 30 and 45 MPa for the measured range, between 5 and 60 MPa for the expandable range, and between 1 and 300 MPa for the broad range. When using polymers as the weaving material, water as coolant and "standard/optimized" architecture as lattice structure, normalized permeability is between 0.004 and 0.014 for the measured range, between 0.001 and 0.04 for the expandable range, and between 0.0001 and 0.4 for the broad range, while shear modulus and Young's Modulus are between 0.05 and 0.5 GPa for the measured range, between 0.01 and 1.5 GPa for the expandable range, and between 0.001 and 4 GPa for the broad range, strength is between 0.5 MPa and 5 MPa for the measured range, between 0.2 MPa and 20 MPa for the expandable range, and between 0.05 and 50 MPa for the broad range.

Pressure gradient and convective heat transfer can be optimized in more than one direction. For instance, when using Cu as the weaving material, water as coolant and "standard/optimized" architecture as the lattice structure, pressure gradient is between 2 and 850 kPa/m for the measured range, between 1 and 2000 kPa/m for the expandable range, and between 0.1 and 10000 kPa/m for the broad range, while heat transfer coefficient is between 4000 and 29000 $W/m^2K$ for the measured range, between 2000 and 50000 $W/m^2K$ for the expandable range, and between 200 and 200000 $W/m^2K$ for the broad range.

Pressure gradient and temperature uniformity can be optimized in more than one direction. For instance, when using Cu as the weaving material, water as coolant and "standard/optimized" architecture as the lattice structure, pressure gradient is between 2 and 850 kPa/m for the measured range, between 1 and 2000 kPa/m for the expandable range, and between 0.1 and 10000 kPa/m for the broad range, while temperature gradient is between 2 and 100 K/m for the measured range, between 1 and 200 K/m for the expandable range, and between 0.2 and 1000 K/m for the broad range.

Convective heat transfer and temperature uniformity can be optimized in more than one direction. For instance, when using Cu as the weaving material, water as coolant and "standard/optimized" architecture as the lattice structure, heat transfer coefficient is between 4000 and 29000 $W/m^2K$ for the measured range, between 2000 and 50000 $W/m^2K$ for the expandable range, and between 200 and 200000 $W/m^2K$ for the broad range, while temperature gradient is between 2 and 100 K/m for the measured range, between 1 and 200 K/m for the expandable range, and between 0.2 and 1000 K/m for the broad range.

A heat transfer device, according to an embodiment of the present invention, is in some embodiments, formed from metallic wires or bundles and yarns of wires arranged in an optimized pattern and joined together using joining material such as braze or solder. In such an implementation, the material for the wires can take a number of different forms. The metallic wires can be formed from single elements like Cu, Ag, Al, etc. or alloys such as Ni-based alloys. Different combinations and compositions of wires can be mixed. Wire dimensions can be the same or different, and wire radial dimensions can vary from 10 μm to 10 mm. Hollow wires can also be used.

In some embodiments, the present invention can take the form of a woven structure in which select wires or bundles and yarns of wires are omitted or removed from the weave so as to optimize more than one property simultaneously. In such an implementation, the material for the wires can take a number of different forms. The metallic wires can be formed from single elements like Cu, Ag, Al, etc. or alloys such as Ni-based alloys. Different combinations and compositions of wires can be mixed. Wire dimensions can be the same or different, and wire radial dimensions can vary from 10 μm to 10 mm. The wires can be solid and fully dense or hollow like a tube.

In some embodiments the present invention can take the form of a heat transfer device that is formed from metallic wires or bundles and yarns of wires and is optimized to accommodate the cooling and geometrical requirements of complex systems. The heat transfer device can also be designed for a system with multiple surfaces that need cooling. The heat transfer device can be tailored to any geometry to satisfy any flat or curved surface that needs cooling.

The preceding includes examples of how the invention might generally be implemented. These implementations are not meant to be considered limiting. Any combination of the foregoing known to or conceivable by one of skill in the art are also included within the scope of the present invention.

EXAMPLES

The exemplary implementations that follow are merely means of illustrating the embodiments, manufacture, uses, and implementations of the present invention. These examples are in no way meant to be considered limiting. Any design for or implementation of the present invention known to or conceivable by one of skill in the art is considered to be within the scope of the present invention.

Figure 1B:
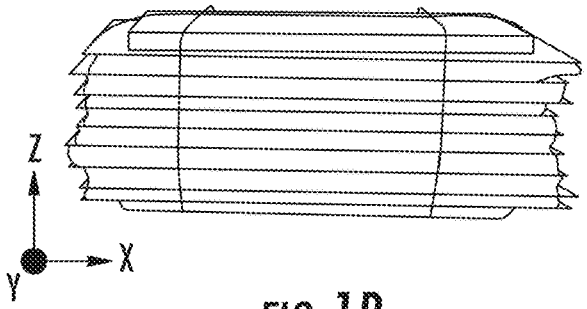
FIG. 1B illustrates a side view of eight weaves stacked with 46 μm thick CuAg eutectic braze foils positioned above, below, and between weaves, all sandwiched between two ceramic blocks to insure the weaves remained flat during brazing, and then heated in a furnace to enable bonding.
Figure 1C:
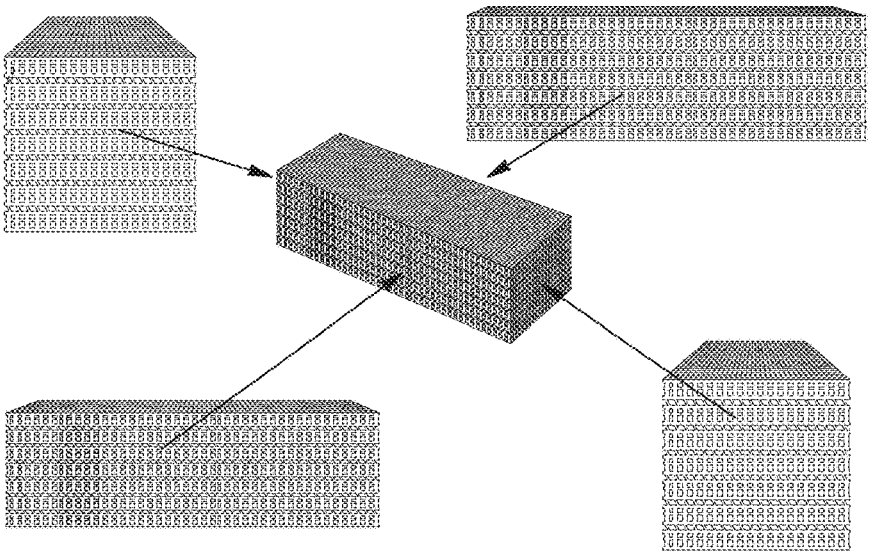
FIG. 1C illustrates side and perspective views of the final Cu blocks measuring 76.2×25.4×23.4 mm. The eight individual weaves can be seen in the cross-sectional views.
Figure 2A:
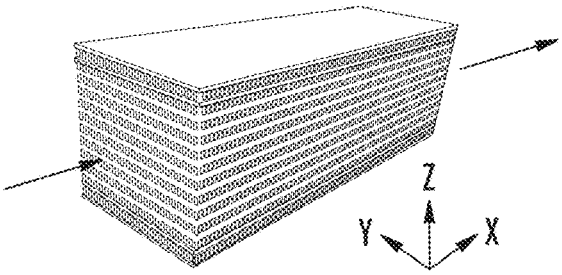
FIGS. 2A-2C illustrate a perspective view of fabricated Cu blocks shown with axial flow in the X direction, full bifurcated flow and focused bifurcated flow in the X and Y directions, respectively.
Figure 2B:
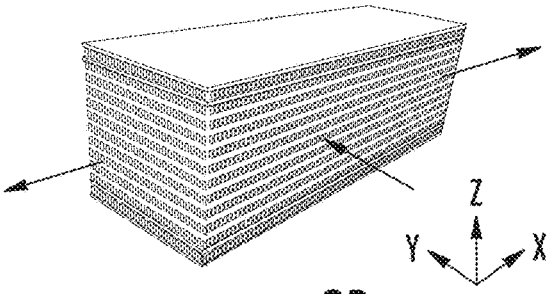
Figure 2C:
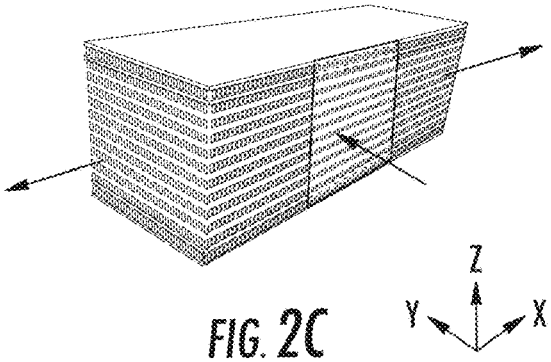
Figure 2D:
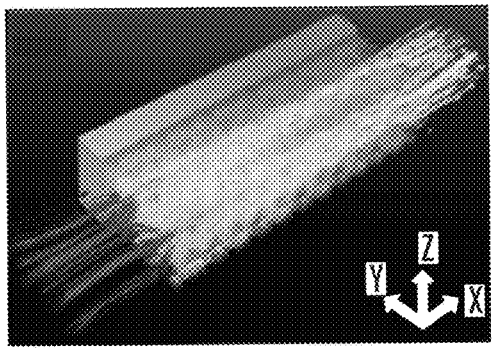
FIGS. 2D-2F illustrate perspective views of heating of a Y surface, and the subsequent temperature distribution during flow and streamlines of fluid for the axial flow, for the full bifurcated flow, and for the focused bifurcated flow generated using finite element modeling, respectively.
Figure 2E:
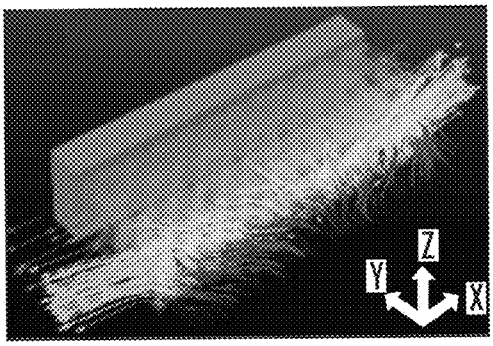
Figure 2F:
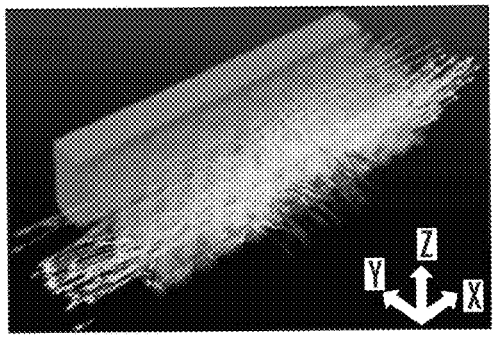

Eight 3.2 mm thick weaves were formed into a Cu block that measures 76.2×25.4×25.4 mm (3×1×1 inch) using a brazing process, as illustrated in FIGS. 1A-1C. In the first step the meter-long, unbonded Cu weaves were cut to slightly over 76.2 mm in length (X) while the full width (Y) was kept at approximately 35 mm (FIG. 1A). To prepare the structure for brazing, 8 individual Cu weaves were stacked together with 46 μm thick CuAg braze foils placed above and below each weave, sandwiched them between two ceramic plates and wrapped the whole structure with NiCr wires to insure flat weaves after brazing. FIG. 1B shows the prepared sample in a glass tube ready for insertion into a furnace. For brazing, the sample was heated to 900° C. over the course of 10 to 15 minutes and held for 5 min to allow the sample to reach a uniform temperature under a 95 mol % $N_2$/5 mol % $H_2$ forming gas atmosphere at 2 psig. The sample was then cooled to 25° C. over the course of 15 minutes and cut in the X and Y directions to the prescribed geometry to form the 3D woven block using electrical discharge machining (EDM), after which no missing or distorted wires were observed. A block manufactured using the optimized woven structure and its four cross sections are shown in FIG. 1C.

Because the woven Cu block is inherently porous in all three normal directions: X, Y and Z, one can characterize heat transfer in any one direction while the cooling fluids flow in one, two or three directions. The wire architecture permeability and volume fractions are orthotropic, which means that coolant flow and heat transfer should vary significantly with orientation. For example, permeability in the Z direction is 3 times smaller than that in the X and Y directions for the optimized architecture. Heat transfer was studied in the Y direction because this direction has a high density of straight Cu wires that span the full width of the block. For cooling, axial (1-D) fluid flow is enabled in the X direction that has the highest permeability and bifurcated (2-D) fluid flow in the X and Y directions. For bifurcated flow, the full bifurcated case that utilizes the whole 3"×1" cross section area as an inlet was studied and the focused bifurcated case that restricts the inlet to only the central 1"×1" area was also studied to reduce short-cuts at the edges and match the same cross section area as seen at the outlet. FIGS. 2A-2F illustrate the exemplary axial flow pattern and the two exemplary bifurcated flow patterns with the fabricated optimized Cu block, in FIGS. 2A-2C, and the corresponding streamlines in finite element modeling, in FIGS. 2D-2F. It should be noted that the rear face of the block can be heated.

Figure 3A:
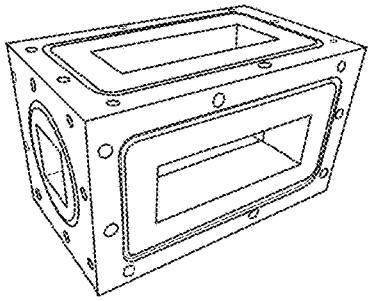
FIG. 3A illustrates a perspective view of a central chamber to fit the sample and adapt the flow patterns.
Figure 3B:
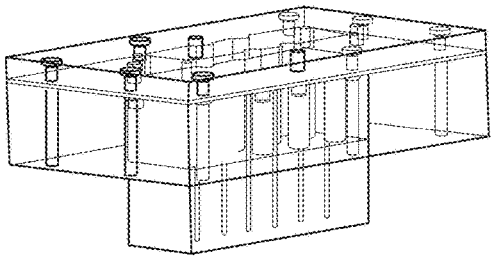
FIG. 3B illustrates a perspective view of a heater block designed with cartridge heaters and thermocouples.
Figure 3C:
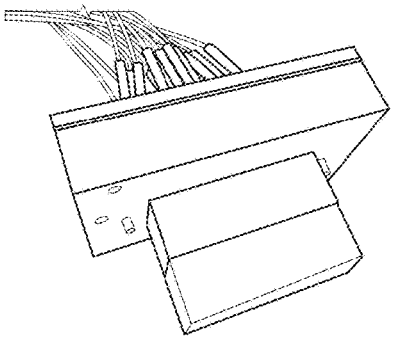
FIG. 3C illustrates a top-down view of a 3D weave soldered to the Cu heating block.
Figure 3D:
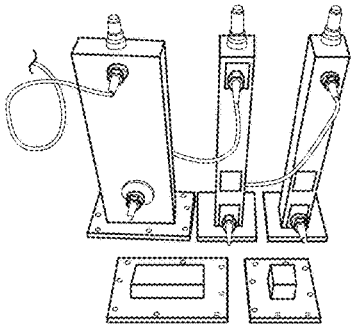
FIG. 3D illustrates a perspective view of the extension arms that guide the fluid and the caps covering the unused windows.
Figure 3E:
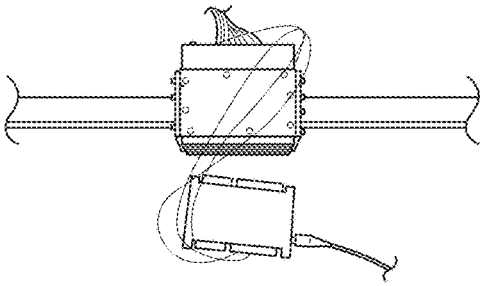
FIG. 3E illustrates a top-down view of an assembly for axial flow pattern test.
Figure 3F:
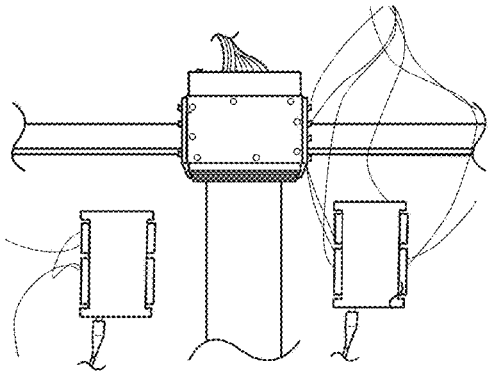
FIG. 3F illustrates a top-down view of an assembly for bifurcated flow pattern test.

To characterize heat transfer properties as fluids flow through the weaves, a versatile rectangular chamber was designed and constructed to enable multiple flow patterns. As can be seen in FIG. 3A, each side of the chamber contains a window that can allow flow into and out of the Cu block or can be closed to prevent flow. A cartridge heater system was designed in FIG. 3B, with ten cartridge heaters embedded in a solid, 50.8 mm long Cu block pressing against the opposite Y face. All the heaters are 25.4 mm long leaving the remaining 25.4 mm of the Cu block to distribute the heat evenly. Each heater is capable of producing 150 W of power, thus a maximum power of 1.5 kW is available for heating the woven Cu block. To measure the surface temperature, seven evenly spaced type T thermocouples with accuracy at 0.1° C. after calibration were inserted into the pre-cut blind holes and soldered to the Cu block, with only a 1 mm distance to the surface of the Cu block that is soldered to the 3D woven sample. FIG. 3C shows the finished setup of the heating system with the woven Cu sample bonded to the Cu heating block. To provide different desired flow patterns, extension arms and covering caps were used as shown in FIG. 3D. The two square extension arms are attached to both X axis faces for axial flow and an extra rectangular arm is added to one Y axis face for bifurcated flow as shown in FIGS. 2A-2F. The extension arms measure 254 mm in length so that fluid is fully developed before entering the Cu block. On each arm, there is a port for fluid's pressure measurement and an Omega TH-44034 thermistor (accuracy: 0.1° C.) for fluid's temperature measurement at the inlet and outlets. FIGS. 3E and 3F show the testing setups for axial and bifurcated flow patterns, respectively, after assembling the chamber, the heater system, and the arms and caps.

Figure 4A:
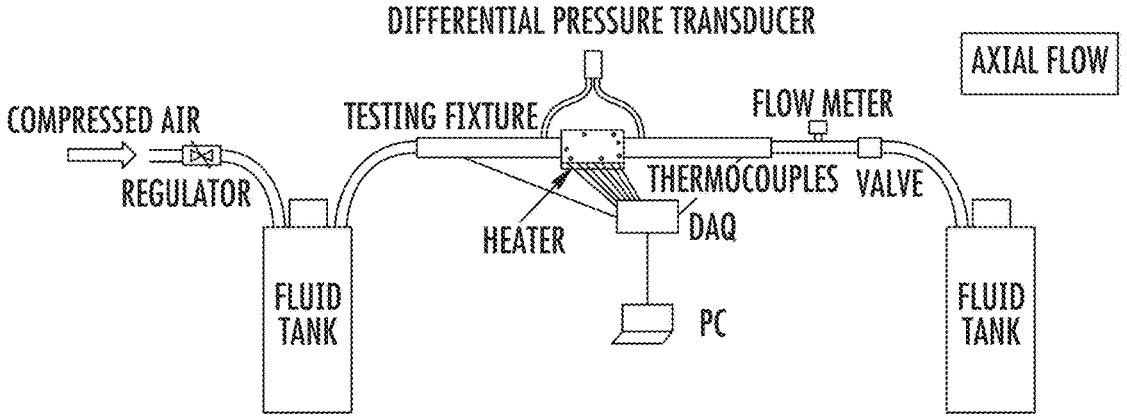
FIGS. 4A and 4B illustrate schematic diagrams of a testing setup for axial and bifurcated flow patterns, respectively.
Figure 4B:
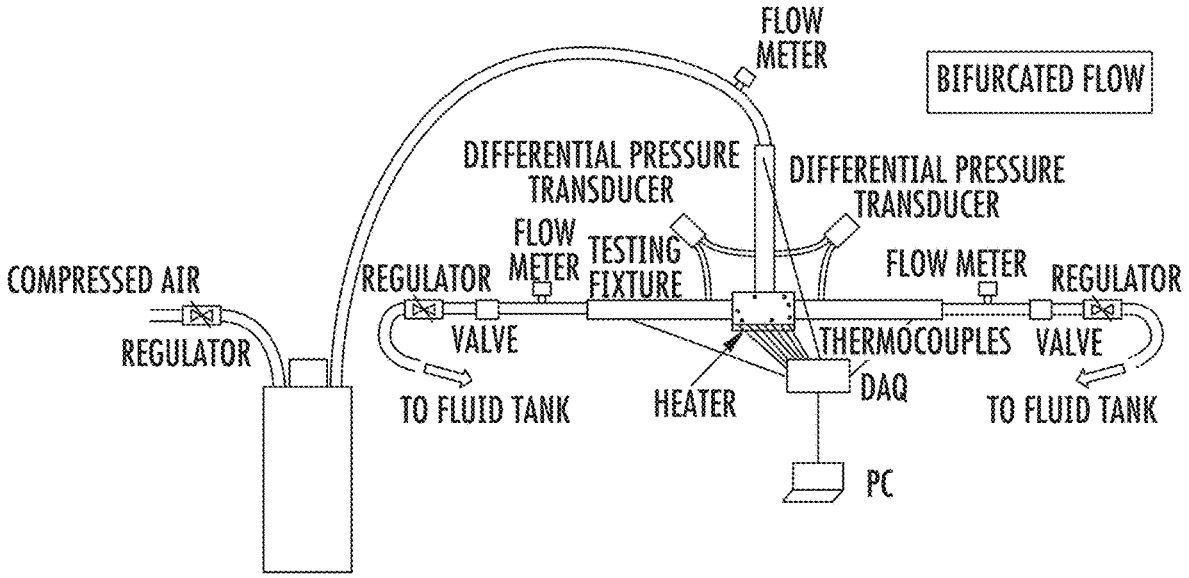
Figure 5A:
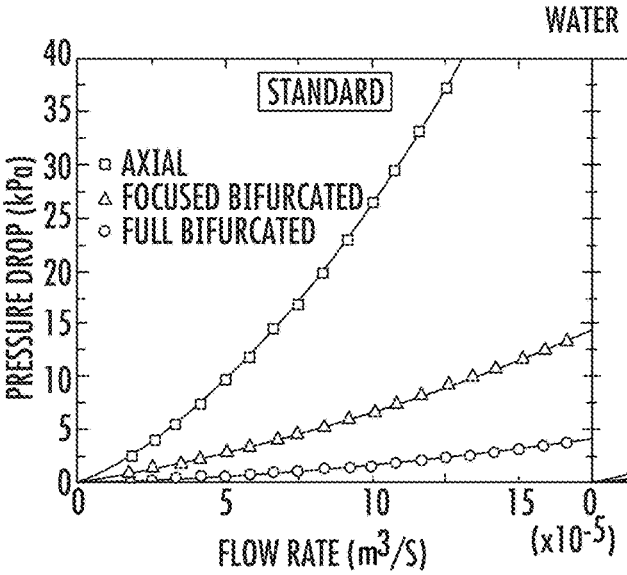
FIGS. 5A-5D illustrate graphical views of pressure drop vs. flow rate with three flow patterns using either water, as in FIGS. 5A and 5B, or air, as in FIGS. 5C and 5D as working fluids, on a standard, as in FIGS. 5A and 5C, or optimized, as in FIGS. 5B and 5D, structure.
Figure 5B:
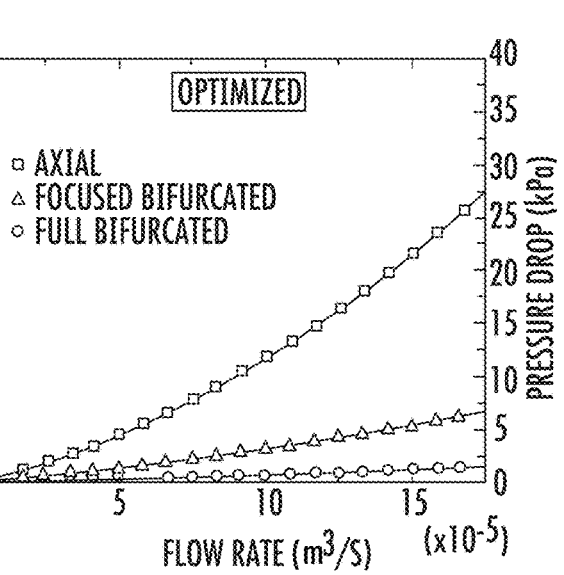
Figure 5C:
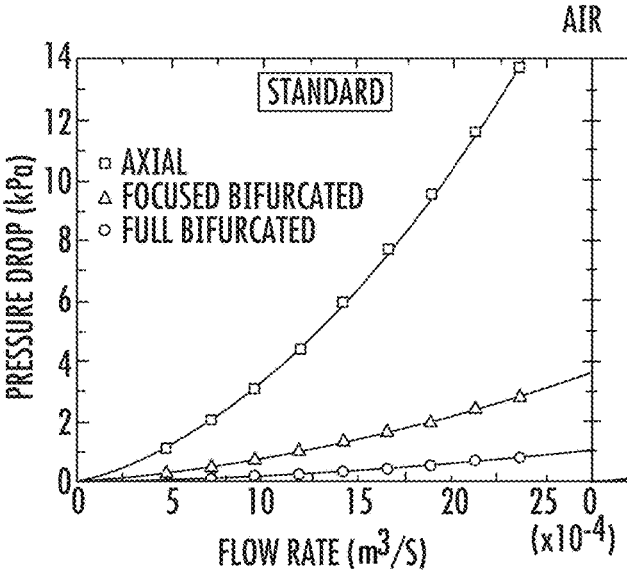
Figure 5D:
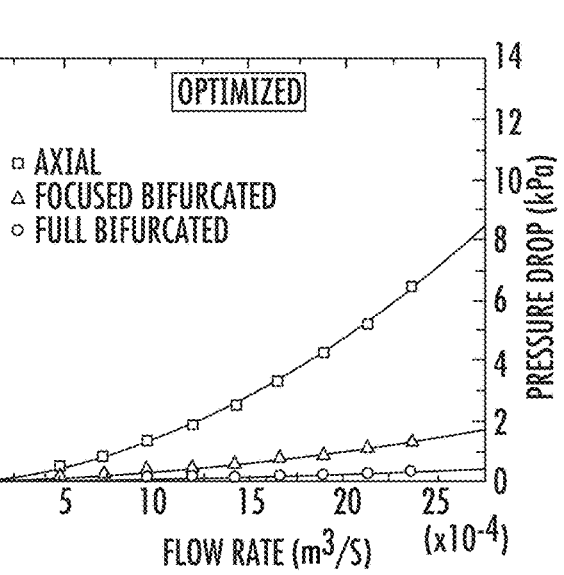

FIGS. 4A and 4B illustrate full test setups for both the axial and bifurcated flow tests, respectively. During each test, either deionized (DI) water or air was used as the working fluid and a fine regulation valve was used to adjust the flow rate to an accuracy of ±0.05%. Pressure drop was measured between the inlet and outlet for the axial flow or between inlet and one of the two outlets for the bifurcated flow using an Omega HHP-803/SIL differential pressure transducer, which can measure to an accuracy of ±70 Pa. Volumetric flow rate was measured using JLC International Inc. 100.21N IR-Opflow flowmeters with ±1% accuracy and Omega FL4500 series acrylic rotameters with ±2% accuracy for testing with water or air, respectively. For the axial flow test, only one flowmeter was used to measure the flow rates. For bifurcated flow test, three identical flowmeters were used to measure the flow rates of both the inlet and the two outlets; a second regulator was added to each of the two outlets to ensure the flow is split 50%/50% between the two outlets. For heat flow, a transformer was used to maintain a constant heat flux (up to 77 W/cm$^2$) to the system. For temperature measurements, all the thermocouples were connected to a USB-Temp Data Acquisition Device from Measurement Computing Inc. and read by InstaCal and TracerDAQ software installed on a PC.

For pressure drop, the relationship between pressure gradient and flow rate in porous materials can be described by the Darcy-Forchheimer equation:

$$\frac{\Delta P}{L} = -\frac{\mu}{K}v - \frac{\rho C_F}{\sqrt{K}}v^2, \tag{1}$$

where ΔP is the pressure drop, L is the sample's length, μ is the fluid's dynamic viscosity, ρ is the fluid's density, v is the fluid's superficial velocity, K is the structure's permeability, and $C_F$ is a dimensionless form-drag coefficient. $C_F$ was initially thought to be a universal constant, with a value of approximately 0.55, but later it was found that $C_F$ does vary with the nature of the porous medium and can be as low as 0.1. This equation is generally used to describe turbulent flow when inertial effects become significant and the dimensionless parameter Reynolds number Re is greater than 10 in porous materials. The definition of Reynolds number is:

$$Re = \frac{\rho D_h}{\mu}v, \tag{2}$$

where $D_h$ is the hydraulic diameter of the structure. Previously, it was determined that the hydraulic diameters for the standard and optimized structures are 297 and 470 μm, respectively. When Re is less than 1, flow is assumed to be in the laminar region and Eq. (1) can be simplified to the Darcy's law by eliminating the quadratic term. Here, Reynolds number ranged from 3 to 125; thus, Eq. (1) was used as a more general form.

For heat transfer measurements, the applied power was fixed by maintaining the voltage at the transformer, and the quantity of heat transferred into the coolant through the Cu weaves was calculated by measuring the temperature difference of coolant between inlet and outlet:

$$Q = c_f \rho v A (T_{out} - T_{in}), \tag{3}$$

where Q is the heat transferred to the coolant per second, $c_f$ is the heat capacity of coolant, A is the cross section area, and $T_{in}$ and $T_{out}$ are the inlet and outlet temperature of the coolant.

A heat transfer coefficient is commonly used to describe the efficiency of forced convection in a heat exchanger, which by definition is:

$$h = \frac{Q}{A_{heated}(T_s - T_f)} = \frac{Q}{A_{heated}(T_s - (T_{out} + T_{in})/2)}, \tag{4}$$

where $A_{heated}$ is the heated surface area (76.2×25.4 mm in all cases), $T_s$ is the average of the seven temperatures measured by the thermocouples located near the surface of the heated block, and $T_f$ is the average fluid temperature ($(T_{out}+T_{in})/2$).

There are two other significant dimensionless parameters other than Reynolds number that are used extensively in fluidic and thermal analysis: the Darcy friction factor f and the Nusselt number Nu. The Darcy friction factor is used to evaluate the flow resistance of a fluid passing through the material and it characterizes the transition from the Darcy laminar regime to the Forchheimer turbulent regime. The Nusselt number describes the heat transfer performance and determines the ratio of convective to conductive heat transfer normal to the boundary. Both of these terms have a strong dependence on the Reynolds number and are usually plotted together. Their definitions are:

$$f_H = \frac{\Delta P}{L} \cdot \frac{H}{\rho v^2/2}, \tag{5}$$

$$Nu_H = \frac{hH}{k_f}, \tag{6}$$

and the definition of Reynolds number is re-written as:

$$Re_H = \frac{\rho v H}{\mu}, \tag{7}$$

where H is the channel height, h is heat transfer coefficient and $k_f$ is the thermal conductivity of fluid. Note that the friction factor, the Nusselt number, and the Reynolds number all include a length scale H in their definitions and this length scale is somewhat arbitrary. However, it usually is included to facilitate comparisons among different topologies. Here the channel height H is 25.4 mm for all the cases.

Utilizing Eqs. (1) and (7), Eq. (5) can be rewritten as:

$$f_H = -\frac{2H^2}{KRe_H} - \frac{2H}{\sqrt{K}}C_F. \tag{8}$$

Note that when $Re_H$ is small and the flow is in the laminar regime, $f_H$ is nearly proportional to $1/Re_H$. When $Re_H$ is intermediate and the flow is in the laminar-turbulent transition regime, $f_H$ is determined by both $1/Re_H$ and $C_F$. When $Re_H$ is large and the flow is in the turbulent regime, $f_H$ is approaching a constant dominated by the $C_F$ term.

Similarly, Nusselt number is usually coupled with the Reynolds number to characterize heat transfer:

$$Nu_H = aRe_H^{\,b}, \tag{9}$$

where the coefficients a and b are experimentally determined. $Nu_H$, although not explicitly seen, usually increases monotonically with $Re_H$, which is a typical result of the fact that turbulent flow enhances heat transfer than laminar flow.

FIGS. 5A-5D illustrate graphical views of the pressure drops at different flow rates for both the standard and optimized structures under three separate flow patterns, using either water or air as working fluid. Note that for the bifurcated flow patterns, pressure drops were measured between the inlet and each of the two outlets independently and the results in FIGS. 5A-5D are averages of both. The two ranges of flow rates (water and air) were chosen so that the resulting Reynolds numbers are comparable to other literature values. Here the Reynolds numbers vary between 200 and 6700 and between 500 and 7500 for water and air tests, respectively, indicating the flow spans from Darcy's regime into the Forchheimer regime. This can also be confirmed by the quadratic trend shown by the experimental data in FIGS. 5A-5D.

Several comparisons can be made using the data in FIGS. 5A-5D. First, regardless of flow pattern or working fluid, pressure drops are approximately twice as large across the standard structure compared to the optimized structure for the same flow rates. This difference can be attributed to the higher volume fraction of material in the standard structure (~51.1%) compared to the optimized structure (~39.4%), and that the pore structure in the optimized structure was designed using topology optimization to maximize flow in the X direction. Comparing the three flow patterns, pressure drop is the highest for the axial flow, intermediate for the focused bifurcated flow (~4× lower) and the lowest for the full bifurcated flow (~16× lower). The significant reduction in attendant pressure drop can be attributed to much shorter average travel distances within the full bifurcated flow pattern compared to the axial flow pattern. Much of the flow can exit the weave at its edges, creating very short travel paths. The focused bifurcated pattern possesses intermediate lengths of the flow paths and the flow behaves like a semi-axial pattern once the fluid enters the structure, "turns", and begins travelling in the X direction. Such comparisons hold for both working fluids, and the relative ratios between the axial, focused bifurcated and full bifurcated curves are similar for both fluids. Lastly, changing the flow pattern has a bigger impact on the pressure drop (~16×) than changing sample's architecture (~2×).

By applying Eq. (1) to the data in FIGS. 5A-5D, permeabilities and form-drag coefficients were obtained and the results are summarized in Table 1, below. Note that due to variations among the three flow patterns, the length of the flow path, L, and the superficial velocity, v, are calculated differently for each pattern. For the axial flow, L is simply the length of the sample (76.2 mm) in the flow direction (X) and v equals the ratio of volumetric flow rate to the cross sectional area (25.4×25.4 mm). For the two bifurcated flows, the length of flow and the velocity of flow vary with locations in the flow pattern. Thus, average values are used for both. L and v. L is obtained using the length of the elliptical curve that connects the center of the right or left half of the inlet area to the center of one of the two outlet areas. L is calculated to be 39.0 mm and 26.3 mm for focused and full bifurcated patterns, respectively. v is an average between the inlet velocity (full volumetric flow rate/inlet cross section area) and the outlet velocity (half volumetric flow rate/outlet cross section area).

Before making any comparison, these calculated parameters are relatively sensitive to the scattered data. Permeability, K, is achieved by extrapolating curves that are fit to the data to zero velocity and calculating the slope, assuming linear Darcy's behavior. However, a quadratic equation is used and the second order term will impact the fitted permeability. In addition, because of the range of Reynolds number, even the data points at low flow rates include a turbulent component, which further complicates the distribution of permeability and form-drag coefficient $C_F$. With these concerns in mind, several trends are described in Table 1. In terms of the two architectures, the permeabilities in the optimized structure are 38% to 181% higher than those in the standard structure, which results from topology optimization and higher porosity in the optimized structure. In terms of the three flow patterns, permeabilities are similar for the axial and focused bifurcated flow patterns but 1.7 to 3.1 times larger for the full bifurcated flow. The axial and focused bifurcated values are similar due to the fact that once the fluid enters into the sample in focused bifurcated flow, its streamlines run in a horizontal manner towards both outlets, nearly matching those of the axial flow pattern. The 1.7× to 3.1× calculated increase in permeability for the full bifurcated flow may be too high due to the potential of overestimating the average flow path L. Currently elliptical streamlines are assumed to be uniformly distributed between the single inlet and the two outlets, however more fluid may escape in the top half of the outlet due to the low flow resistance which eventually causes the actual L to be smaller than predicted. This would return a smaller value of permeability, closer to the values calculated for the other flow patterns.

Continuing the comparison of the data in Table 1, the permeabilities calculated for air are higher than those for water. This is often observed when the pressure gradient varies nonlinearly with flow rate (disobeys Darcy's law) and when testing in media with low permeabilities. Other studies have shown large discrepancies between permeabilities calculated for air and water with values for air typically being higher than those for water due to the compressibility of gas and the phenomena of slip (Klinkenberg effects). Comparing the permeabilities for the woven blocks to previous measurements on the single layer weaves, the permeabilities for the blocks made from the standard weave are 2~3 times higher than the single layer of standard weave whereas the permeabilities for the optimized blocks and single layers are similar. The differences are attributed to the small gaps that arise between layers during the fabrication of the blocks, because the layers do not braze together perfectly flat. The resulting gaps have a permeability that increases the overall permeability of the standard weave layers but is similar to the overall permeability of the optimized weave layers. Lastly, the form-drag coefficients $C_F$ vary between 0.07 and 0.63, which is typical for porous medium, and the values for air are higher than those for water because of the stronger turbulent effects in air.

TABLE 1

Permeability K and form-drag coefficient $C_F$ for the standard and optimized blocks. Water or air was used as working fluid and three flow patterns were individually applied.

| | | Standard Structure | | Optimized Structure | |
|---|---|---|---|---|---|
| Fluid | Flow Pattern | K ($\times 10^{-10}$ m$^2$) | $C_F$ | K ($\times 10^{-10}$ m$^2$) | $C_F$ |
| Water | Axial | 9.9 | 0.245 | 19.5 | 0.133 |
| | Focused Bif. | 10.3 | 0.120 | 21.5 | 0.071 |
| | Full Bif. | 23.9 | 0.401 | 32.9 | 0.104 |
| Air | Axial | 16.5 | 0.361 | 46.3 | 0.293 |
| | Focused Bif. | 18.4 | 0.204 | 45.1 | 0.159 |
| | Full Bif. | 50.5 | 0.626 | 74.7 | 0.256 |

Figures 6A, 6B:
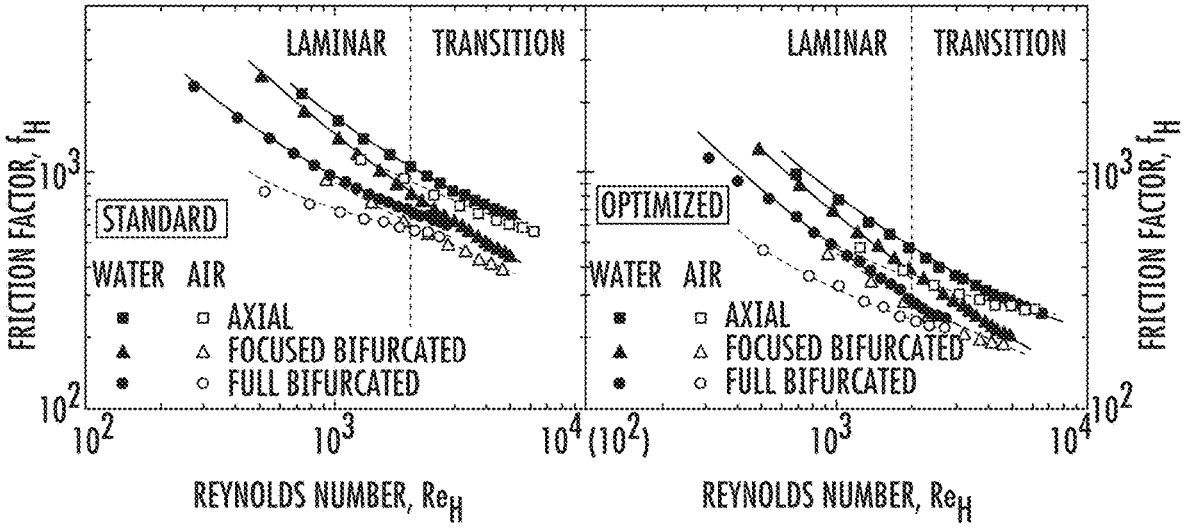
FIGS. 6A and 6B illustrate graphical views of friction factor vs. Reynolds number for 3D woven lattice blocks with either standard or optimized architecture, respectively, based on channel height. Water or air was used as working fluid and three flow patterns are considered.
Figure 7A:
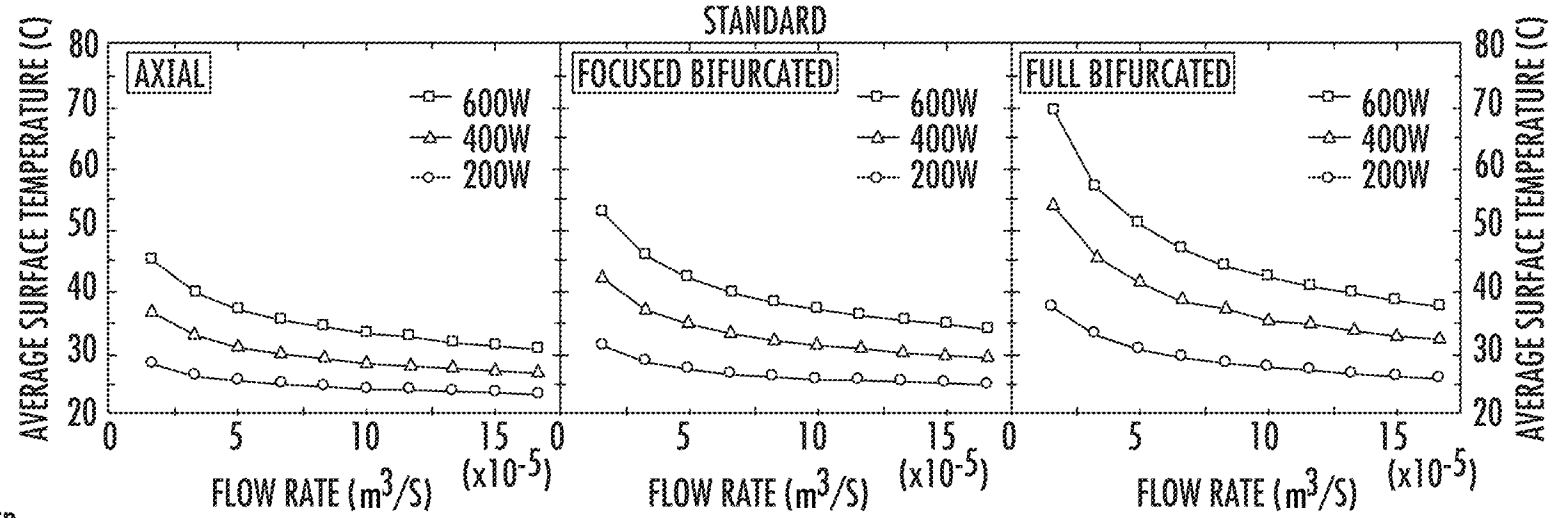
FIGS. 7A-7D illustrate graphical views of average surface temperature vs. flow rate with three flow patterns using either water, as in FIG. 7A or 7B or air, as in FIGS. 7C and 7D, as working fluid, on a standard, as in FIGS. 7A and 7C or optimized, as in FIGS. 7B and 7D, structure. For water, three different heat fluxes were applied (600 W, 400 W and 200 W); while for air, two different heat fluxes were applied (75 W and 50 W).
Figure 7B:
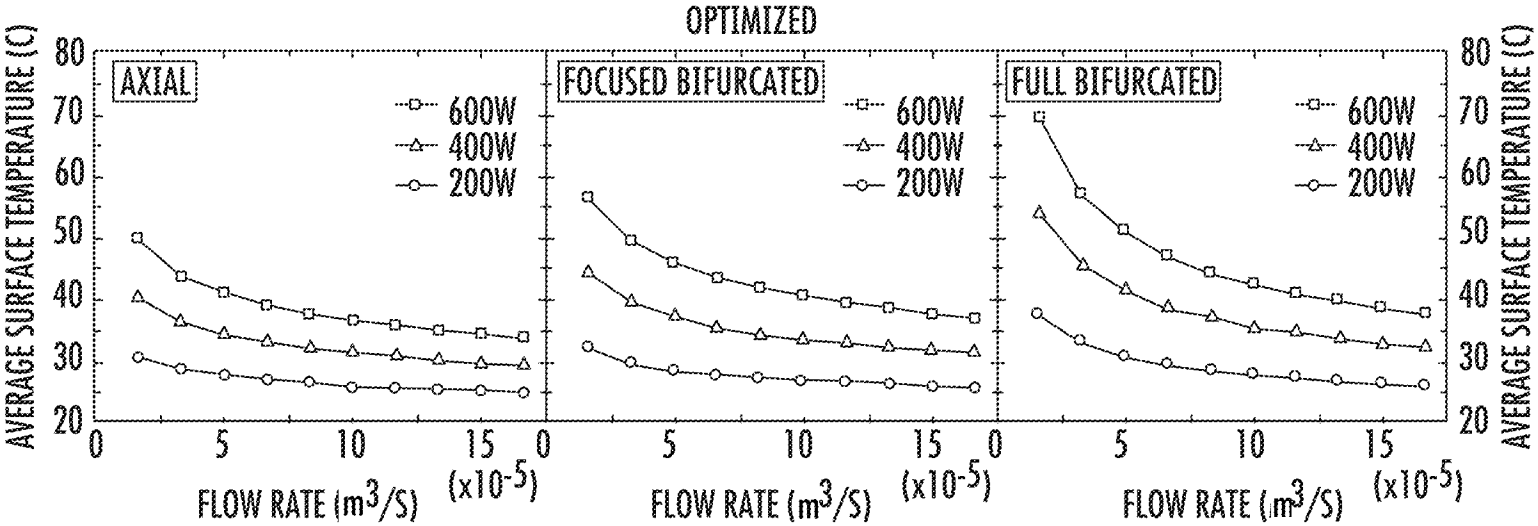
Figure 7C:
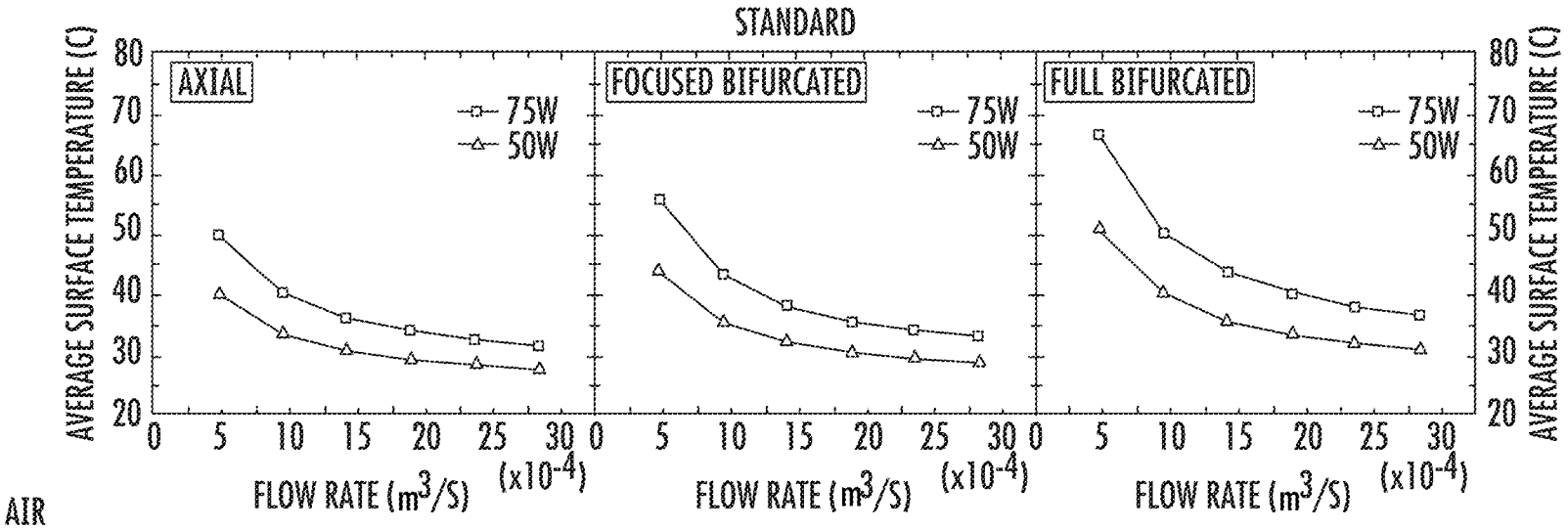
Figure 7D:
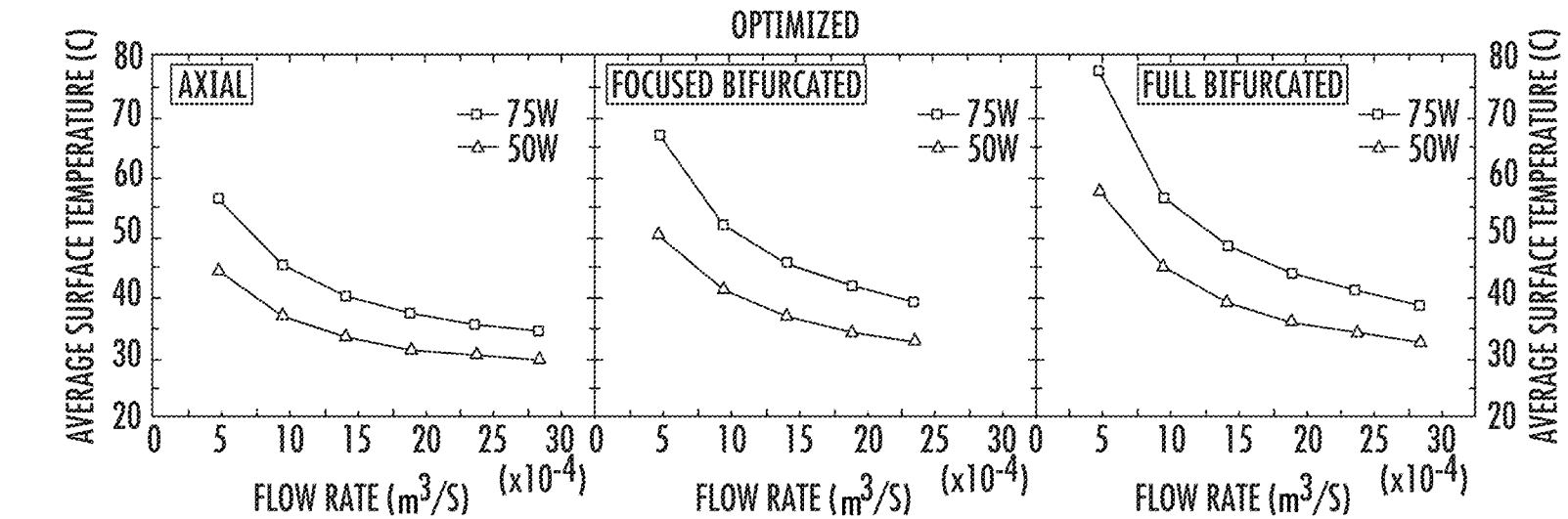
Figure 8A:
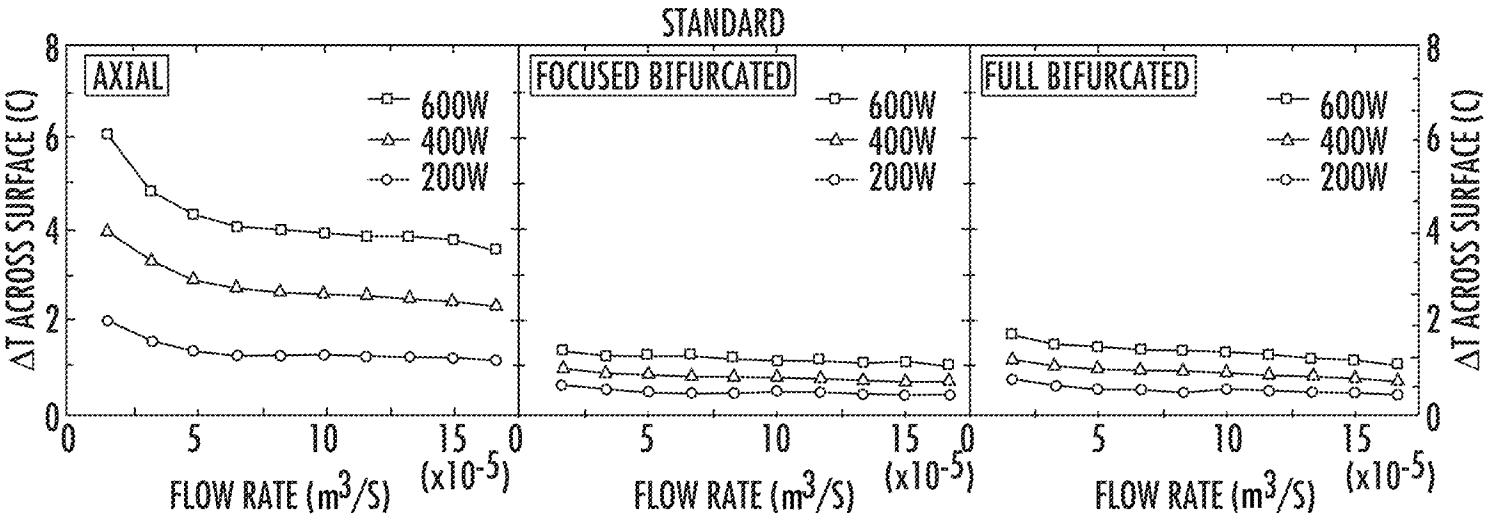
FIGS. 8A-8D illustrate graphical views of ΔT across the surface vs. flow rate with three flow patterns using either water, as in FIG. 8A or 8B or air, as in FIGS. 8C and 8D, as working fluid, on a standard, as in FIGS. 8A and 8C or optimized, as in FIGS. 8B and 8D, structure. For water, three different heat fluxes were applied (600 W, 400 W and 200 W); while for air, two different heat fluxes were applied (75 W and 50 W).
Figure 8B:
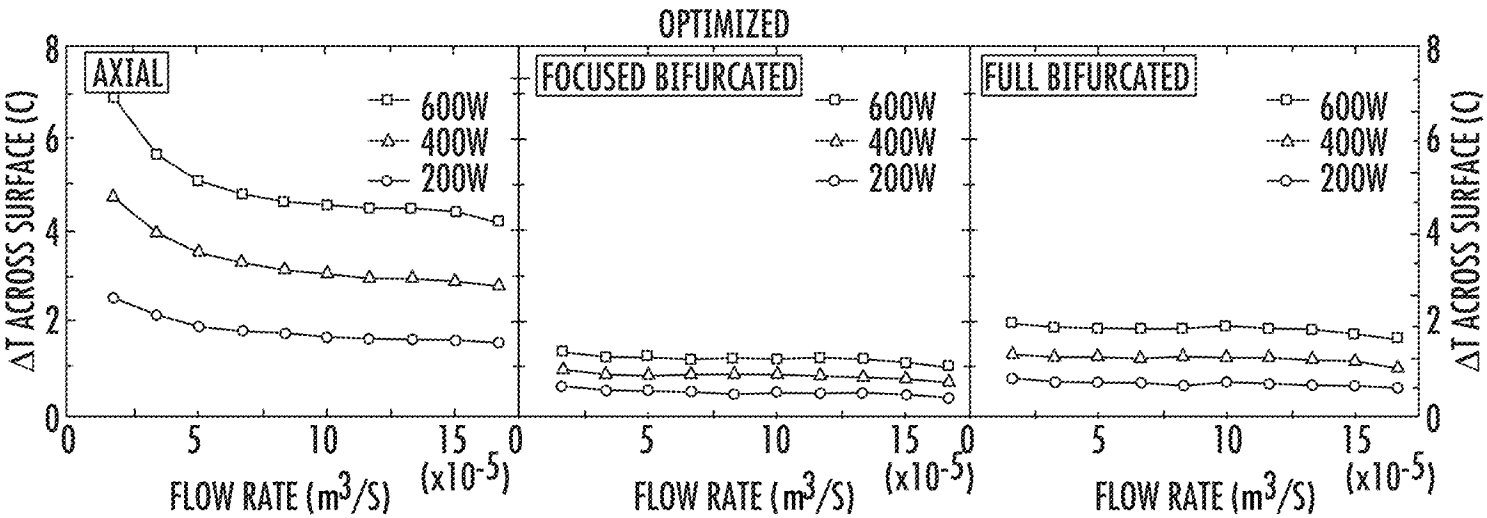
Figure 8C:
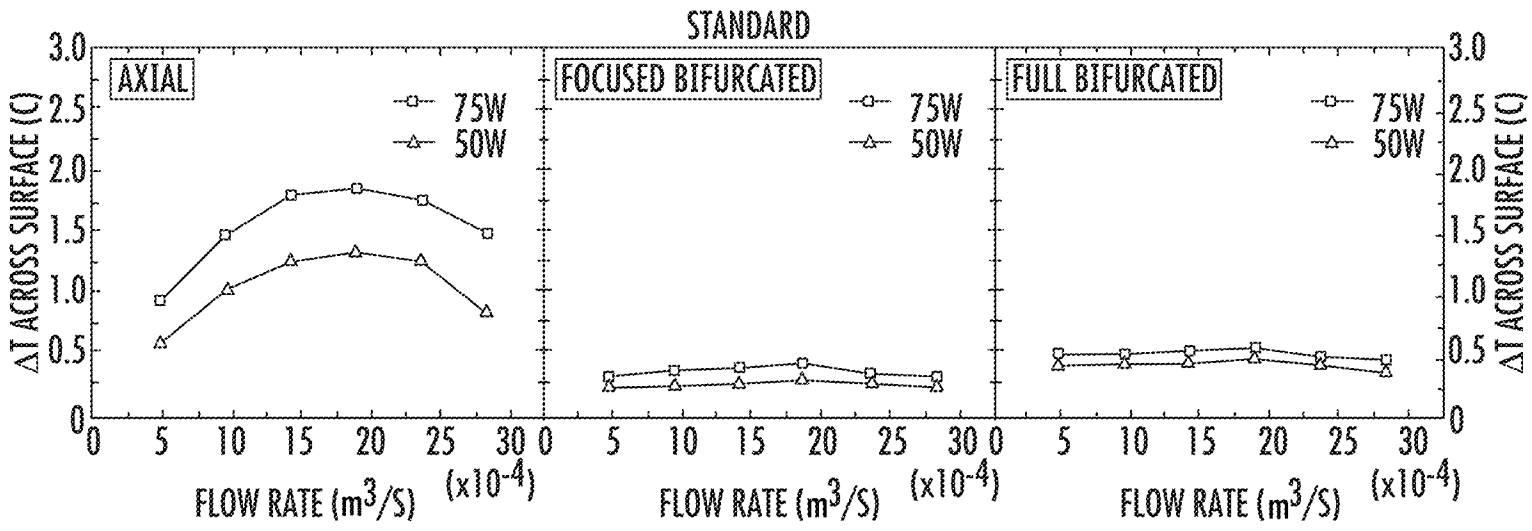
Figure 8D:
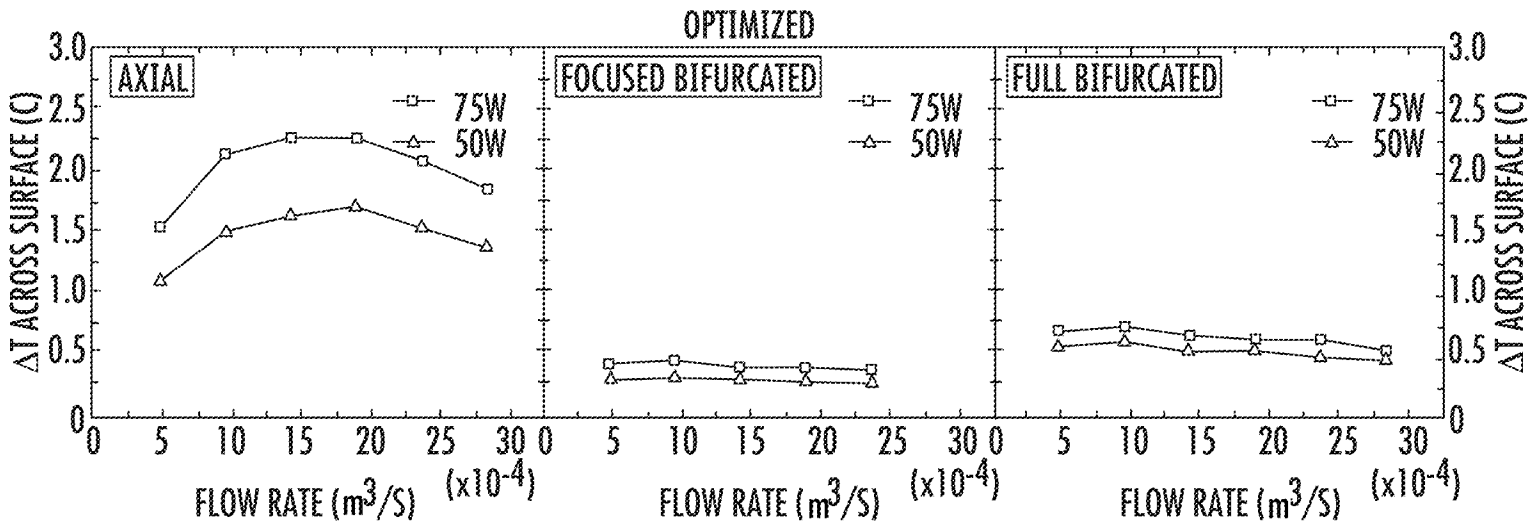

Using the values shown in Table 1, the friction factor was calculated for all three flow patterns and both fluids using Eq. (8) and the resulting values are plotted in FIGS. 6A and 6B. Several trends can be observed. First, the friction factor is higher for the standard structure compared to the optimized structure, because the former is denser and flow resistance is higher. Second, friction factors are slightly higher when using water as opposed to air for low Reynolds numbers but similar for higher Reynolds numbers, within experimental uncertainties. Overall, the difference in friction factor for the two coolants is not significant, which is reasonable given the friction factor does not explicitly depend on a fluid's properties as shown in Eq. (8). Such independence has also been observed in other porous media. Third, comparing the three different flow patterns, the flow resistance ascends from the full bifurcated to the focused bifurcated to the axial flow pattern. This is expected considering the increasing average path length for the three structures. Lastly, a transition from a laminar flow regime to a laminar-turbulent flow regime appears to occur in FIGS. 6A and 6B near a Reynolds number of 2000, as seen in other porous materials.

With the seven thermocouples measuring the surface temperature, the average surface temperature ($\bar{T}$) and temperature variation across the surface (ΔT) are quantified. Both depend on weave architecture, flow pattern and working fluid, as well as input heat flux and flow rate. Here a series of experiments were conducted by applying three different input powers (600 W, 400 W and 200 W) to the heater block while cooling with water and two smaller input powers (75 W and 50 W) while cooling with air. Coolant flow rates were varied systematically and pressure drops were measured at each flow rate. FIGS. 7A-7D and 8A-8D summarize T and ΔT for all combinations of input powers and flow rate. In general, both parameters increase with higher heat flux and decrease with higher flow rates.

Several trends standout in FIGS. 7A-7D and 8A-8D. First, both $\bar{T}$ and ΔT are lower in the standard weave compared to the optimized weave for a given input heat flux, flow pattern and flow rate. This difference is attributed to the fact that the standard structure has more wires to enhance thermal conduction through solid struts, more surface area to enhance thermal convection between the solid Cu and the cooling fluid, and smaller pore sizes to create more localized turbulent vortex. Second, of the three flow patterns, axial flow always possesses the lowest average temperature, $\bar{T}$, while the full bifurcated flow has the highest $\bar{T}$. This trend scales with the length of the coolant flow path. When the flow path is long (L=76.2 mm for axial) there is more time for heat to dissipate from the Cu wires into the cooling fluid and thereby lower the heating block surface temperature compared to when the flow path is short (L=26.3 mm for full bifurcated). The average temperature and flow path length (L=40.5 mm) for the focused bifurcated flow path both fall in between those for the axial and full bifurcated paths. In terms of changes in temperature, axial flow always possesses the highest ΔT because the cooling fluid is continuously heated when sweeping past the warm surface and is less effective at cooling as its temperature rises. Between two bifurcated flow patterns, lower ΔT's were observed with the focused than the full bifurcated flow. This is because that although the highest temperature is always at the center, the lowest temperature occurs somewhere between the center and the edges for the focused bifurcated whereas always at the edges for the full bifurcated flow due to the different flow patterns. Lastly, in FIGS. 8C and 8D it can be seen that ΔT first rises and then falls with increasing flow rates for air tests, which was not observed in the water tests. This is due to the fact that the heat capacity and density of air are much smaller compared to water, and when testing with air at very low flow rates, thermal conduction within the solid wires prevails over thermal convection between the wires and the fluid. This results in a smoothing of the temperature variations across the surface and hence a lower ΔT. Once the flow rates are higher, thermal convection begins to dominate over thermal conduction and the general decrease in ΔT with flow rate is again observed.

Knowing the average surface temperature $\bar{T}$ and the average temperature of the coolant (measured separately), Eq. (4) was used to quantify heat transfer coefficients and the resulting values are plotted in FIGS. 9A-9D. The data shows that heat transfer coefficient is independent of the input heat flux, which results from the fact that a change in the input power Q is balanced by changes in the temperature difference ($T_s$–$T_f$) between the solid surface and the fluid that absorbs the input heat. One can also notice that a higher heat transfer coefficient is observed in the standard structure compared to the optimized structure and in the axial flow pattern compared to the other flow patterns due to the lower average surface temperature $\bar{T}$ shown in FIGS. 7A-7D. Lastly, water is much more effective in dissipating heat than air per unit temperature difference between the solid and the fluid, attributed to water's superior thermal conductivity, heat capacity and Prandtl number.

Figures 10A, 10B:
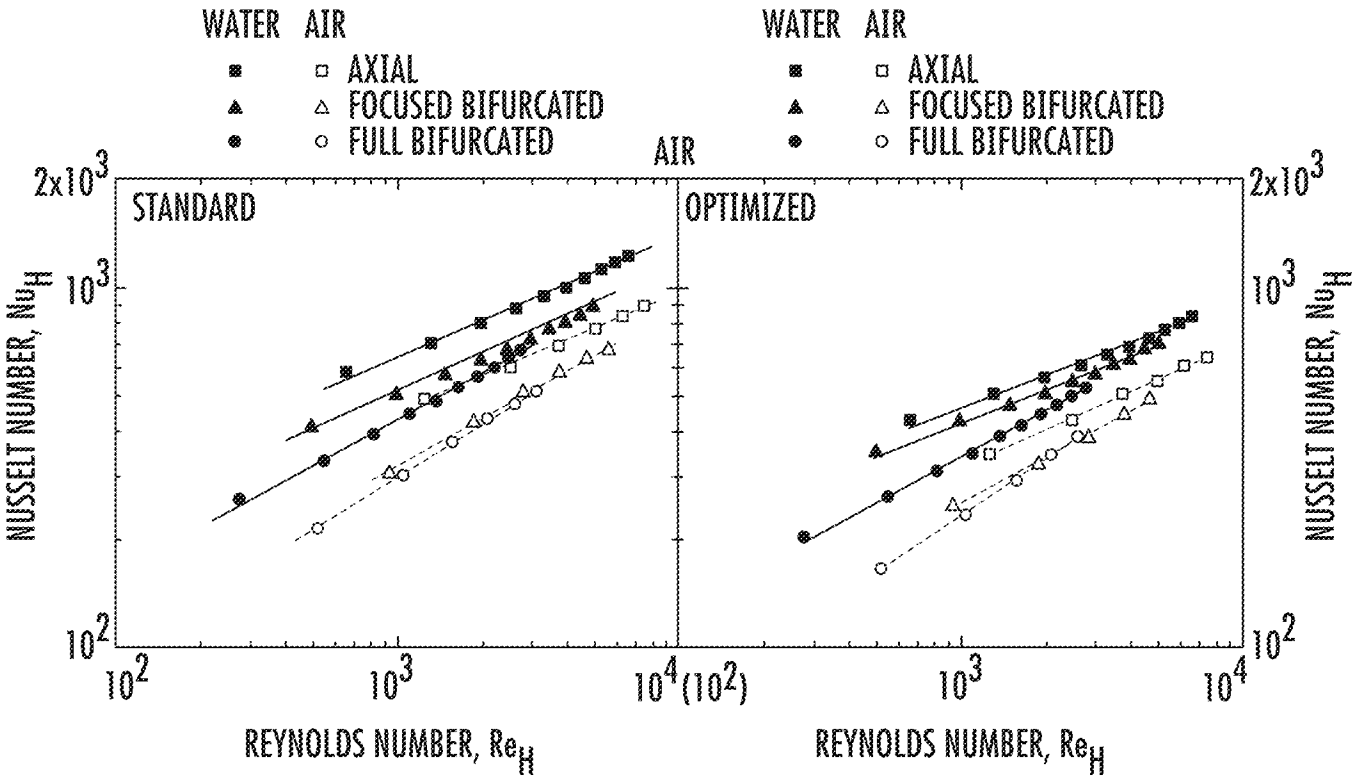
FIGS. 10A and 10B illustrate graphical views of Nusselt number vs. Reynolds number for 3D woven lattice blocks with either standard or optimized architecture, respectively, based on channel height. Water or air was used as a working fluid and three flow patterns were individually applied.

Similar to the friction factor vs. Reynolds number comparison in the pressure drop analysis, values for the Nusselt number and the Reynolds number obtained using Eqs. (6) and (7) were plotted, and the linear fits to the data in FIGS. 10A and 10B are used to obtain the coefficients, a and b, in Eq. (9) and the results are listed in Table 2, below. Comparing the data in FIGS. 10A-10B and Table 2, the standard weave structure under axial flow with water as the coolant has the best heat transfer performance as expected. However, it is also found that the slope (b) for the full bifurcated flow is slightly higher than the slopes for the other two flow patterns. This difference is attributed to the fact that when flow is faster, the fluid streamlines vary little in location for the axial and focused bifurcated flow, respectively, but they move deeper towards the heated surface for the full bifurcated flow. As a result, the temperature gradient between the heated surface and cooling water increases more in the full bifurcated flow pattern, which leads to a bigger increase in effective heat transfer at higher flow rates and a greater slope in FIGS. 10A-10B. Based on this observation, the thickness of the sample can be reduced so that the streamlines can move closer to the heated surface. However, this also reduces the amount of solid material available for heat transfer and increases the pressure drop within the system. Knowing this, an optimization of both the sample geometry and the flow patterns should be undertaken to produce the most effective thermal and fluidic performance for a given application. When comparing to other literature values, the coefficients a and b are higher than most of the other porous heat exchanger media such as micro trusses, metallic foams, and sintered packed beds.

TABLE 2

Fitted coefficients a and b in Eq. (9) for the standard and optimized architectures. Water or air was used as a working fluid and three flow patterns were individually applied.

| | | Standard Structure | | Optimized Structure | |
|---|---|---|---|---|---|
| Fluid | Flow Pattern | a | b | a | b |
| Water | Axial | 61.8 | 0.34 | 57.5 | 0.30 |
| | Focused Bif. | 46.4 | 0.35 | 50.1 | 0.31 |
| | Full Bif. | 21.7 | 0.43 | 17.6 | 0.43 |
| Air | Axial | 40.9 | 0.35 | 27.9 | 0.35 |
| | Focused Bif. | 16.3 | 0.43 | 12.3 | 0.44 |
| | Full Bif. | 10.5 | 0.49 | 5.6 | 0.54 |

Having quantified and reviewed fluidic and thermal properties (pressure drop, average surface temperature, $\bar{T}$, and temperature variation on the heated surface, ΔT) as a function of weave architecture, flow pattern, and fluid coolant one can conclude that there is not one ideal solution for all applications. For example, considering weave structures, the standard structure possesses larger pressure drops but superior heat transfer performance due to its larger volume fraction of solid material compared to the optimize structure. In a similar manner, the axial flow pattern also has a larger pressure drop and a larger ΔT but superior heat transfer compared to the other two flow patterns. Thus, while a standard weave in an axial flow pattern may be best for optimizing heat transfer, an optimized weave in one of the two bifurcated flow patterns would be better for applications were pumping power is limited and/or temperature uniformity is required. Taking these discussions one step further, the bifurcated flow patterns may be superior in general because their high average temperatures, $\bar{T}$, can be lowered more readily with higher flow rates than the high changes in temperature, $\Delta T$, can be lowered in the axial flow pattern. Looking at FIGS. 7A-7D and 8A-8D one can see that higher axial flow rates are needed to drop the $\Delta T$ to the level found for the bifurcated flows than the bifurcated flow rates needed to reach the same $\bar{T}$ found for the axial flows. In addition, the pressure drop is much larger for the axial flow pattern.

Similar to FIGS. 6A and 6B and 10A and 10B, other articles have summarized friction factor $f_H$ and Nusselt number $Nu_H$ for a wide range of Reynolds number $Re_H$ of various heat dissipation media. This broader data set for other heat exchanger medium including: empty channel, corrugated ducts, louvered and mini fins, copper, aluminum and iron base alloy foams, sintered and non-sintered packed beds, aluminum wire-woven bulk Kagome truss cores, stainless steel and copper textile cores, and lattice frame materials are plotted in FIGS. 11, 12A and 12B along with data for the Cu woven structures. Given that the friction factor, $f_H$, does not explicitly include any coolant's properties and this is relatively independent of the choice of coolant, only one plot for $f_H$ vs. $Re_H$ was made by combining the results for water and air coolants in FIG. 11. On the other hand, since $Nu_H$ explicitly includes the thermal conductivity of the fluid and heat transfer performance depends on the choice of coolant, two separate plots are presented in FIGS. 12A and 12B, one for water and one for air as coolant.

Figure 11:
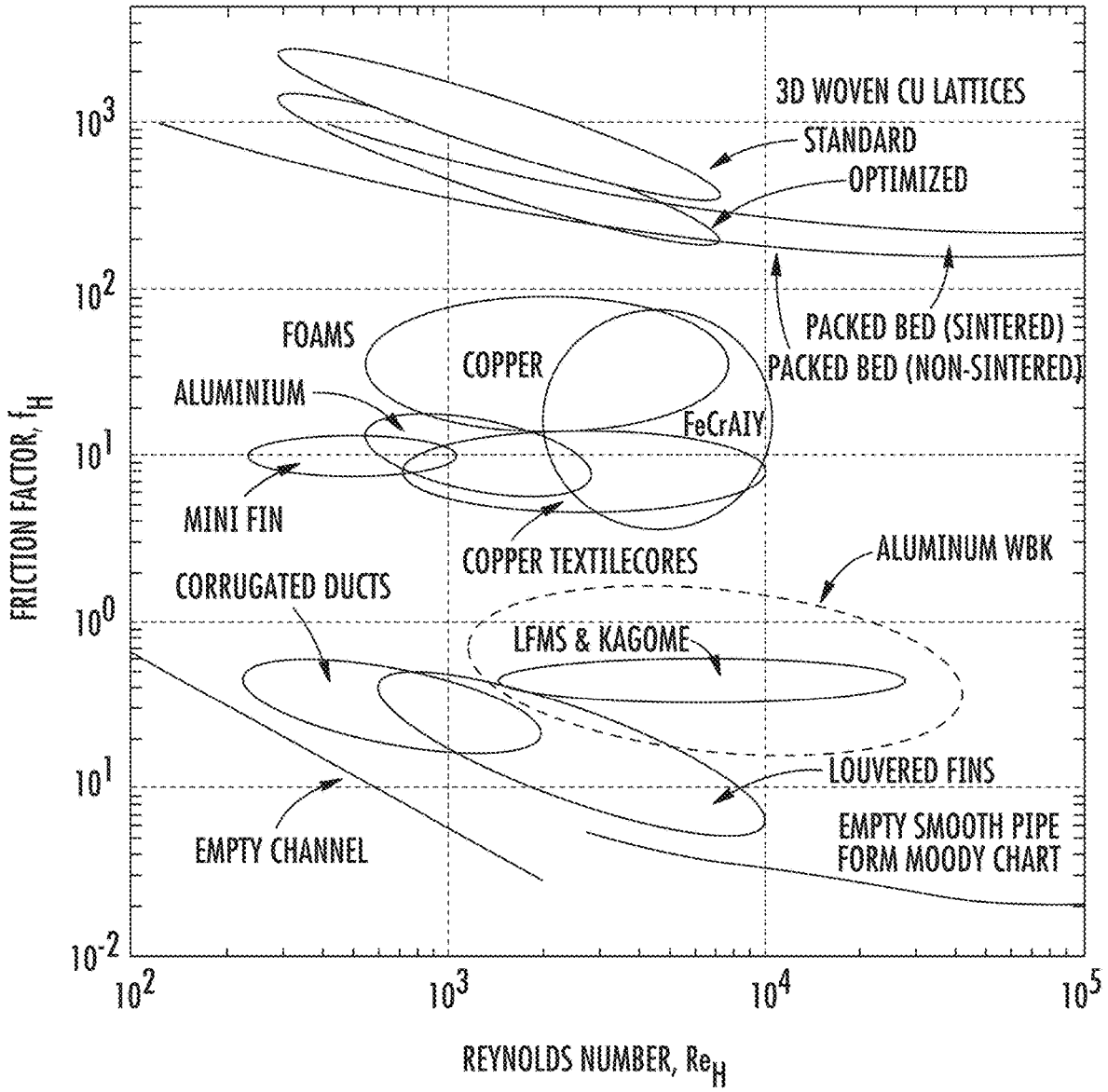
FIG. 11 illustrates a graphical view of friction factor vs. Reynolds number comparing 3D woven Cu lattices with other heat exchanger media based on channel height.

FIG. 11 shows that the friction factor for 3D woven lattices is comparable to $f_H$ for the packed beds while it is higher than most of the other porous materials. This is mainly due to the different porosities and geometries associated with the different structures. Porosities are less than 50% for the 3D woven Cu lattices and packed beds, whereas they are as high as 70% to 80% for the screen textiles and typically more than 80% for the foams. Lower porosity means higher material density, thus more material and contact area to increase flow resistance. On the other end, different geometries also play a big role in determining the friction factor. Unlike the structures that possess some ligaments in the core cells, the simple straight channel structure in finned structures minimizes complex flow mixing and secondary flows, thus yielding dramatically lower pressure losses. As a result, even though the porosity of mini-fins can be as low as 36%, flow resistance is very small and thus the friction factor is quite low as well. It is worth noting that although higher pumping power may be needed to drive the same flow rates in the weaves, compared to the other porous media, this power is achievable and can be satisfied by most pumps.

Figure 12A:
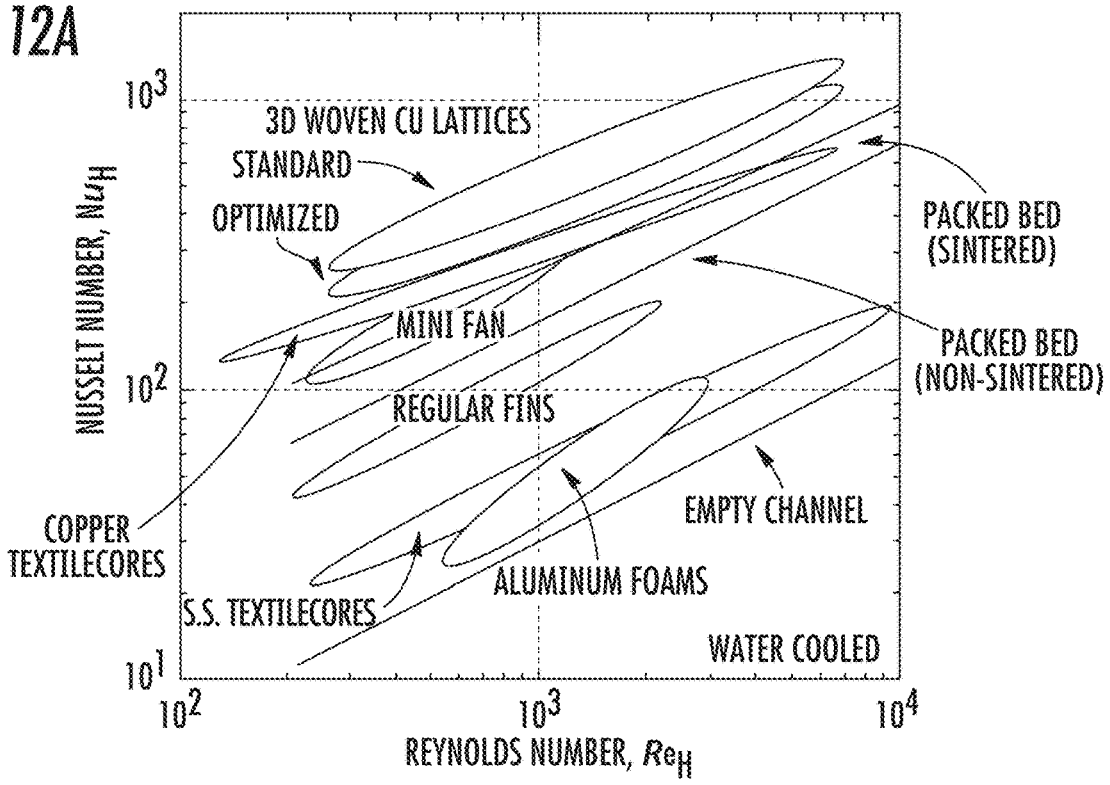
FIGS. 12A and 12B illustrate graphical views of Nusselt number vs. Reynolds number comparing 3D woven Cu lattices with other heat exchanger media based on channel height using either water or air, respectively, as working coolant.
Figure 12B:
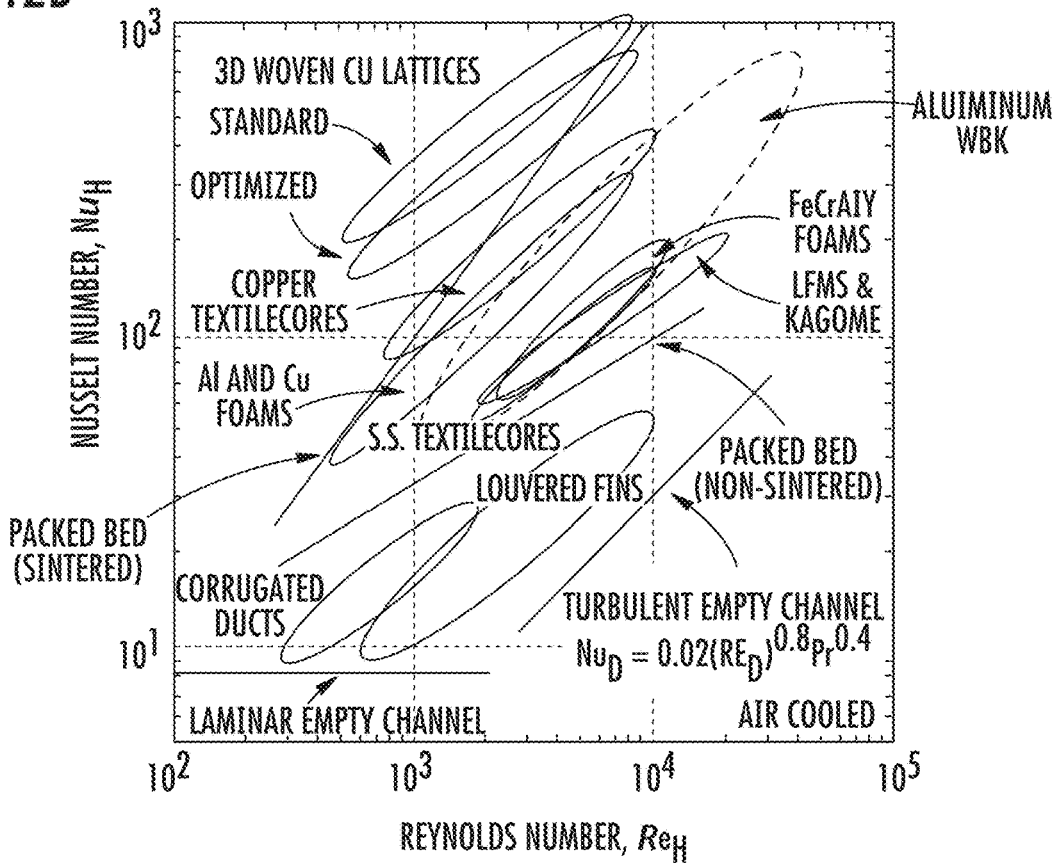

In FIGS. 12A and 12B, in terms of heat transfer the 3D woven Cu lattices outperform all the other heat exchangers that are listed, regardless of coolant. (This performance is estimated to improve by up to 75% if a more conductive AgCu braze is used in place of the SnPb solder when bonding the weaves to the heat source.) The superior performance of weaves is attributed to their regular flow channels and pore sizes, Cu's high thermal conductivity, a high volume density of solid ligaments that enhance thermal conduction, and a high specific surface area that enhances forced convection between the solid and liquid. Considering other heat exchanger media, finned heat sinks have high surface areas that enhance heat transfer but their straight flow channels limit secondary fluid mixing. Metallic foams possess tortuous flow channels and high specific surface areas, yet have limited thermal transport via conduction due to their low material volume fraction and stochastic structure. Lastly, screen textile cores have regular flow channels and high thermal conduction, but possess low specific surface area due to a large pore size to wire diameter ratio. Finally, the data in FIGS. 12A and 12B does not include information regarding temperature uniformity on the substrate. This is a key design variable that can benefit tremendously from the adoption of bifurcated flow patterns on the weaves as seen in FIGS. 8A-8D.

In summary, given the fluidic and thermal comparisons of weaves to other heat exchanger media, they are ideal media candidates when the design problem is to maximize heat transfer with limited constraints on either the pressure drop or the pumping power. The outstanding heat transfer capabilities and temperature uniformities make weaves particularly useful in applications such as the cooling of high power electronics or the maintenance of temperature uniformity across temperature sensitive laser diodes. Furthermore, the structure of the weaves and the flow patterns through the weaves can still be optimized significantly. The two specific woven structures tested here were designed to optimize stiffness and permeability simultaneously, not heat transfer. Further still, the three flow patterns were chosen for their geometric simplicity and ease of manufacturing. Fluidic and thermal performance can be improved significantly for specific applications by optimizing the weave's inherent structure, the sample's outer geometry, and the coolant flow pattern.

Fluidic and thermal properties of 3D woven Cu lattices were experimentally investigated as novel heat exchangers that were initially topology-optimized to maximize fluid permeability and mechanical stiffness. Using two architectures (standard and optimized), three flow patterns (axial, focused bifurcated and full bifurcated) and two coolants (water and air) pressure drops were quantified across the weaves and average temperatures and changes in temperatures at the heated surface were measured.

In general, the standard structure is more effective at heat transfer than the optimized structure but leads to higher pressure drops due to the larger volume fraction of solid material. The axial flow pattern provides the best heat transfer capability for both woven structures but yields a higher pressure drop and less temperature uniformity compared to the two bifurcated flow patterns. While water and air have similar friction factors, water is more effective at removing heat due to its higher thermal conductivity and heat capacity. With this baseline information in hand, the weaving structure, the specific flow pattern and the choice of coolant can be tailored for improved performance in specific applications.

Lastly, the 3D woven Cu lattices showed higher thermal performance compared to other common heat dissipation media. While their flow resistance is high due to larger volume fractions of material and larger specific surface areas, these characteristics enhance fluid mixing within the regular pores, thermal conduction within the solid ligaments, and forced convection between the solid and the fluid. These benefits in turn lead to a higher thermal performance that outperforms the other heat exchangers. In applications where maximum heat transfer is preferred while pressure drop or pumping power is not constrained, 3D woven Cu lattices offer a promising alternative. When these superior fluidic and thermal properties are considered in combination with earlier reports of significant stiffness, the 3D woven Cu lattices become novel heat exchanger with exciting load bearing capabilities.

It should be noted that computer programming can be used to apply optimization to the organization, material content, geometry and position of the wires in the structure as well as determining and modeling optimized flow through the heat transfer device either with or without a header.

A non-transitory computer readable medium that can be read and executed by any computing device can be used for implementation of the computer based aspects of the present invention. The non-transitory computer readable medium can take any suitable form known to one of skill in the art. The non-transitory computer readable medium is understood to be any article of manufacture readable by a computer. Such non-transitory computer readable media includes, but is not limited to, magnetic media, such as floppy disk, flexible disk, hard disk, reel-to-reel tape, cartridge tape, cassette tapes or cards, optical media such as CD-ROM, DVD, Blu-ray, writable compact discs, magneto-optical media in disc, tape, or card form, and paper media such as punch cards or paper tape. Alternately, the program for executing the method and algorithms of the present invention can reside on a remote server or other networked device. Any databases associated with the present invention can be housed on a central computing device, server(s), in cloud storage, or any other suitable means known to or conceivable by one of skill in the art. All of the information associated with the application is transmitted either wired or wirelessly over a network, via the internet, cellular telephone network, RFID, or any other suitable data transmission means known to or conceivable by one of skill in the art. A specialized and novel computing device that is configured to execute the method of the present invention is also included within the scope of the invention.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. A device for providing heat management, comprising:
a plurality of wires configured to create a heat management material,
the plurality of wires to form a three-dimensional (3D) woven lattice,
the 3D woven lattice including:
a first set of wires in an x-direction,
a second set of wires in a y-direction, and
a third set of wires in a z-direction,
wherein the 3D woven lattice is configured to be optimized in one or more directions by removing at least one wire in each of the x-direction and the y-direction,
wherein optimization of the 3D woven lattice is based upon adjustment of two or more heat management qualities or mechanical qualities of the 3D woven lattice selected from the following:
fluid permeability,
mechanical stiffness,
mechanical strength,
pressure drop,
pumping power,
heat transfer, or
temperature uniformity,
wherein a normalized fluid permeability of the 3D woven lattice ranges from between about 0.0001 to about 0.4,
wherein the plurality of wires have diameters of between about 10 microns to about 10 mm,
wherein a volume fraction of the 3D woven lattice ranges from between about 10% to about 65%, and
wherein the plurality of wires of the optimized 3D woven lattice are bonded at intersections between adjacent wires.

2. The device of claim 1, wherein the plurality of wires are formed from one selected from a group consisting of:
a metal,
a ceramic, and
a polymer.

3. The device of claim 1, wherein the plurality of wires are formed from copper.

4. The device of claim 1, wherein the plurality of wires are formed from a non-metal.

5. The device of claim 1, wherein diameters of plurality of wires are a same or different.

6. The device of claim 1, wherein the plurality of wires are woven with a warp and a fill.

7. The device of claim 1, wherein the plurality of wires are woven with a warp, fill, and a Z wire.

8. The device of claim 1, wherein the plurality of wires are composed of a bonding material.

9. The device of claim 1, wherein the optimization is performed to design the 3D woven lattice with properties that are adjusted in one or more directions.

10. The device of claim 1, wherein parameters of the wires are selected to adjust heat transfer properties,
the parameters are selected from a group consisting of:
wire position,
wire material chemistry,
wire size,
wire coating, roughness,
wire shape,
wire bonding,
varying composition of plurality of wires in the 3D woven lattice, and
wire architecture.

11. The device of claim 1, wherein the plurality of wires are in a form of a yarn.

12. The device of claim 1, wherein parameters of the plurality of wires are selected to adjust one or more of:
the mechanical stiffness,
the fluid permeability, and
the pumping power.

13. The device of claim 1, wherein the plurality of wires are solid or hollow.

14. The device of claim 1, wherein a normalized fluid permeability of the 3D woven lattice ranges from between about 0.0001 to about 0.4, and
wherein the plurality of wires have diameters of between about 10 microns to about 10 mm.

15. The device of claim 14, wherein the 3D woven lattice has a Young's modulus of between about 0.01 and 200 GPa, a shear modulus of between about 0.1 and 100 GPa, and a strength of between about 1 and 300 MPa.

16. A method for forming a heat management material, comprising:
positioning a plurality of wires in an x-direction, a y-direction, and a z-direction to form the heat management material,
the plurality of wires to form a three-dimensional (3D) woven lattice,
the 3D woven lattice including:
a first set of wires in the x-direction, a second set of wires in the y-direction, and a third set of wires in the z-direction; and selecting a plurality of parameters of the plurality of wires to adjust, the plurality of parameters of the plurality of wires being adjusted computationally, wherein adjustment of the plurality of parameters of the plurality of wires is based upon adjustment of two or more heat managements qualities of the 3D woven lattice selected from the following:

pressure drop, pumping power, heat transfer, or temperature uniformity;

removing at least one wire in each of the x-direction, the y-direction, and the z-direction to adjust the 3D woven lattice in one or more directions; and bonding the plurality of wires of the adjusted 3D woven lattice at intersections between adjacent wires.

17. The method of claim 16, wherein a volume fraction of the 3D woven lattice ranges from between about 10% to about 65%.

18. The method of claim 16, wherein the 3D woven lattice has a Young's modulus of between about 0.01 and 200 GPa, a shear modulus of between about 0.1 and 100 GPa, and a strength of between about 1 and 300 MPa.

* * * * *